US005567571A

United States Patent [19]

Nishikawa

[11] Patent Number: 5,567,571

[45] Date of Patent: Oct. 22, 1996

[54] SILVER HALIDE COLOR PHOTOGRAPHIC LIGHT-SENSITIVE MATERIAL

[75] Inventor: Toshihiro Nishikawa, Minami-ashigara, Japan

[73] Assignee: Fuji Photo Film Co., Ltd., Kanagawa, Japan

[21] Appl. No.: 527,915

[22] Filed: Sep. 14, 1995

Related U.S. Application Data

[63] Continuation of Ser. No. 297,940, Aug. 31, 1994, abandoned, which is a continuation of Ser. No. 74,560, Jun. 11, 1993, abandoned.

[30] Foreign Application Priority Data

Jun. 12, 1992 [JP] Japan ..... 4-177693

[51] Int. Cl.[6] ..... G03C 1/46

[52] U.S. Cl. ..... 430/506; 430/567; 430/603; 430/605

[58] Field of Search ..... 430/506, 567, 430/603, 605

[56] References Cited

U.S. PATENT DOCUMENTS 4,686,176 8/1987 Yagi et al. ..... 430/506
5,112,733 5/1992 Ihama ..... 430/603
5,212,052 5/1993 Sakanoue et al. ..... 430/503
5,320,937 6/1994 Ihama ..... 430/567

*Primary Examiner*—Geraldine Letscher
*Attorney, Agent, or Firm*—Birch, Stewart, Kolasch & Birch, LLP

[57] ABSTRACT

A color photographic light-sensitive material comprises at least two silver halide emulsion layer groups having different color sensitivities on a support. Each group contains at least two silver halide emulsion layers to essentially the same spectral range and having different sensitivities. A highest-speed layer of these at least two silver halide emulsion layers contains a silver halide emulsion in which selenium-sensitized silver halide grains with an aspect ratio of 3 or more occupy 50% or more of a total projected area. A lowest-speed layer of the at least two silver halide emulsion layers contains a selenium-sensitized regular crystal silver halide emulsion. In development of this light-sensitive material, a method of continuously processing which comprises exposing said photographic light-sensitive material, subjecting said photographic light-sensitive material to a developing solution and replenishing a developer solution with not mre than 500 ml of developer replenishing solution per 1 $m^2$.

16 Claims, No Drawings

SILVER HALIDE COLOR PHOTOGRAPHIC LIGHT-SENSITIVE MATERIAL

This application is a continuation of application Ser. No. 08/297,940 filed on Aug. 31, 1994, now abandoned, which is a continuation of application Ser. No. 08/074,560 filed Jun. 11, 1993, now abandoned.

BACKGROUND OF THE INVENTION

1. Field of the Invention

The present invention relates to a silver halide color photographic light-sensitive material and, more particularly, to a silver halide color photographic light-sensitive material having a high sensitivity and little waste of processing solutions, and also excellent in stability in so-called low-replenishment processing.

2. Description of the Related Art

The technological progress of silver halide color photographic light-sensitive materials (including a color negative film and color reversal light-sensitive materials, which will be generally referred to as simply a color negative film hereinafter) has continued without a hitch, and so ISO-sensitivity 400-class light-sensitive materials, which was once called super high sensitivity film, has begun to be used as regular film for common users.

Much research has been made to achieve high sensitivities and high image qualities. For example, each of JP-A-58-113930 ("JP-A" means Published Unexamined Japanese Patent Application), JP-A-58-113934, and JP-A-59-119350 discloses a multilayered color photographic light-sensitive material that uses silver halide emulsions consisting of tabular grains with an aspect ratio of 8:1 or more in high-speed layers and has a high sensitivity and is improved in graininess, in sharpness, and in color reproducibility. In addition, as a method of improving sharpness and color reproducibility, JP-A-61-77847 discloses a method of using silver halide emulsions consisting of tabular grains with an aspect ratio of 5:1 or more in high-speed layers and monodisperse emulsions in low-speed layers.

The development of these light-sensitive materials, on the other hand, has recently begun to be performed by so-called low-replenishment processing, in which the quantity of replenisher is reduced by controlling the composition of a replenisher of a color developing solution, in order to prevent water pollution and reduce processing cost. The control of the replenisher composition in the low-replenishment processing is to, for instance, concentrate waste components, such as a color developing agent and a preservative, so that a necessary amount of components is supplied even if the quantity of replenisher is reduced. When the processing as described above is performed for a silver halide photographic light-sensitive material, however, an antifoggant, for example, flowing out from the light-sensitive material is accumulated in a developing solution, and this causes the development performance to vary. The smaller the quantity of replenisher, the larger the influence.

The above low-replenishment processing was performed for the light-sensitive material disclosed in JP-A-61-77847, in which silver halide emulsions consisting of tabular grains with an aspect ratio of 5:1 or more were used in high-speed layers and monodisperse emulsions were used in low-speed layers. The result was that the reduction in sensitivity and the change in gradation were too large to reach a satisfactory level from the point of view of stability.

As described above, no conventional light-sensitive materials and developing methods can achieve good graininess, sharpness and color reproducibility and a high sensitivity at the same time.

SUMMARY OF THE INVENTION

The present invention has been made in consideration of the above situation and has as its object to provide a silver halide color photographic light-sensitive material having a high sensitivity and a good graininess and also excellent in stability in low-replenishment processing, and a method of processing the same.

The present inventors have made extensive studies in order to achieve the above object of the present invention and found that the object can be achieved by means described in items (1) and (2) below.

(1) A silver halide color photographic light-sensitive material comprising at least two silver halide emulsion layer groups having different color sensitivities on a support, wherein each of the at least two silver halide emulsion layer groups contains at least two silver halide emulsion layers sensitive to essentially the same spectral range and having different sensitivities, a highest-speed layer of the at least two silver halide emulsion layers contains a silver halide emulsion in which selenium-sensitized silver halide grains with an aspect ratio of 3 or more occupy 50% or more of a total projected area, and a lowest-speed layer of the at least two silver halide emulsion layers contains a silver halide emulsion containing selenium-sensitized regular crystal grains.

(2) A method of continuously processing a silver halide color photographic light-sensitive material described in item (1) which comprises exposing said photographic light-sensitive material, subjecting said photographic light-sensitive material to a developing solution and replenishing a developer solution with not more than 500 ml of developer replenishing solution per 1 $m^2$.

The effect of the present invention can be obtained by specifying the combination of grain shapes of emulsions in high- and low-speed layers and the chemical sensitization method. This effect, however, is a totally unexpected discovery at this point of time at which not so many findings concerning the stability of low-replenishment processing have been obtained yet.

DETAILED DESCRIPTION OF THE PREFERRED EMBODIMENTS

The present invention will be described in detail below.

A silver halide photographic light-sensitive material of the present invention has emulsion layer groups with a multilayered structure formed by overlapping emulsion layers for independently recording blue, green, and red light components, each containing binders and silver halide grains. In each emulsion layer group, one emulsion layer is a high-speed layer, and another emulsion layer is a low-speed layer. Examples of a particularly practical layer arrangement are as follows.

(1) BH/BL/GH/GL/RH/RL/S (2) BH/BL/GH/RH/GL/RL/S (3) BH/BL/GH/GM/GL/RH/RM/RL/S (4) BH/GH/RH/BL/GL/RL/S (5) BH/BL/GH/RH/GM/GL/RM/RL/S

In the above layer arrangements, B represents a blue-sensitive layer; G, a green-sensitive layer; R, a red-sensitive layer; H, a highest-speed layer; M, a medium-speed layer; L, a low-speed layer; and S, a support. Non-light-sensitive layers, such as a protective layer, a filter layer, an interlayer, an antihalation layer, and a subbing layer, are omitted from the above layer arrangements. Of these layer arrangements, the arrangements (1) to (3) are most preferable.

In the light-sensitive material of the present invention, a high-speed layer in each emulsion layer group contains an emulsion comprising of tabular grains.

In the present invention, the emulsion comprising of tabular grains means an emulsion in which tabular silver halide grains with an aspect ratio (equivalent-circle diameter/grain thickness of a silver halide grain) of 3 or more occupy 50% by area or more of all silver halide grains.

The emulsion of the present invention is preferably an emulsion in which tabular silver halide grains with an aspect ratio of 3 or more, and more preferably 3 to 10 occupy 50% by area or more, more preferably 70% or more, and most preferably 85% or more of all silver halide grains contained in the emulsion.

The "tabular grain" is a general term of grains having one twin plane or two or more parallel twin planes. The twin plane is a (111) face on both sides of which all ions at lattice points have a mirror image relationship to each other. When this tabular grain is viewed from the above, it looks like a triangle, a hexagon, or a rounded triangle or hexagon. The triangular, hexagonal, and rounded grains have parallel triangular, hexagonal, and rounded outer surfaces, respectively.

In the present invention, the aspect ratio of a tabular grain is the value obtained by dividing the grain diameter of a tabular grain having that of 0.1 μm or more by the thickness of that grain. The thickness of a grain can be easily measured by depositing a metal together with a latex as a reference obliquely on a grain, measuring the length of the shadow of the latex in an electron micrograph, and calculating by referring to the length of the shadow of the latex.

In the present invention, the grain size is the diameter of a circle having an area equal to the projected area of parallel outer surfaces of a grain. The projected area of a grain can be obtained by measuring the area in an electron micrograph and correcting the photographing magnification. The diameter of the tabular grain is preferably 0.15 to 5.0 μm, and its thickness is preferably 0.05 to 1.0 μm.

More favorable results can sometimes be obtained by using monodisperse tabular grains. A method of preparing monodisperse tabular grains is described in, e.g., JP-A-63-151618.

In the present invention, each silver halide grain contained in a silver halide emulsion preferably has at least a core and an outermost shell. In the tabular grain, the core and the outermost shell can be formed to be displaced laterally from the center of two opposing (111) major faces. In this structure, a most central region of the major face is called the core, and a region that forms the periphery of the major face is called the outermost shell. In this case, therefore, both the core and the outermost shell can form the surface of a grain. In these tabular grains, the core and the outermost shell can also be formed to be displaced in a direction perpendicular to the two opposing (111) major faces. In this case, a most central region of a sandwich-like structure is called the core. In addition, it is also possible to form the core and the outermost shell to be displaced laterally from the center of the two opposing (111) major faces and, at the same time, to form the core and the outermost shell constituting a sandwich-like structure to be displaced in a direction perpendicular to the major faces. In this structure, an internal phase can be covered with a continuous phase of the outermost shells. In this case, the internal phase is called the core, and the continuous phase is called the outermost shell.

The core of the silver halide tabular grain described above consists of silver bromoiodide, silver bromochloroiodide, silver iodochloride, or silver bromide. The core preferably consists of silver bromoiodide containing 0 to 12 mol % of silver iodide. More preferably, the core consists of silver bromide or silver bromoiodide containing 6 mol % or less of silver iodide.

The outermost shell of the above silver halide tabular grain consists of silver bromochloroiodide or silver bromoiodide having a higher silver iodide content than that of the core. The silver iodide content of the outermost shell is preferably 1 to 40 mol %, and more preferably 2 to 30 mol %.

The tabular grain of the present invention most preferably has at least one intermediate shell between the core and the outermost shell. This intermediate shell is one or more silver halide phases that are normally continuous but may have an island-sea structure in some cases. The intermediate shell preferably consists of silver bromochloroiodide, silver bromoiodide, or silver bromide. The intermediate shell preferably has a halogen-converted silver halochloride layer, silver thiocyanate layer, or silver citrate layer described in JP-A-1-102547. When one or more intermediate shells are present, the silver iodide content of each shell is preferably 0 to 40 mol %, more preferably 30 mol % or less, and most preferably 20 mol % or less.

In the present invention, the silver iodide contents of the core and the shells of the silver halide grains as described above may take an average value if the silver iodide contents change continuously between shells having different silver iodide contents or between the core and the shell.

The ratios of the core, the intermediate shell, and the outermost shell in the entire grain may take arbitrary values. The ratio of the outermost shell is preferably 5% to 50%, and most preferably 10% to 30% as a molar fraction.

The ratio of the core and the intermediate shell to the outermost shell can be 1:0.1 to 10 as a molar ratio.

The silver iodide content of the entire grain can be controlled by the ratios of the core, the intermediate shell, and the outermost shell and their respective silver iodide contents. The silver iodide content of the entire grain is preferably 10 mol % or less, more preferably 5 mol % or less, and most preferably 3 mol % or less.

In the present invention, the average silver iodide contents of individual grains of an emulsion are preferably as uniform as possible. The uniformity of the average silver iodide contents of grains can be checked by, e.g., an Electron-Probe Micro Analyzer method.

Silver halide emulsions consisting of the tabular grains used in the present invention are described in the report by Cugnac and Chateau, Duffin, "Photographic Emulsion Chemistry," (Focal Press, New York, 1966), pages 66 to 72, and A. P. H. Trivelli and W. F. Smith ed., "Photo Journal," 80 (1940), page 285, and can be prepared easily by making reference to the methods described in JP-A-58-113927, JP-A-58-113928, and JP-A-58-127921.

That is, seed crystals in which the weight ratio of tabular grains is 40% or more are first formed in a relatively high-pAg environment with a pBr of 1.3 or less. Tabular silver halide grains can then be obtained by simultaneously adding silver solutions and halogen solutions to the seed crystals with the pBr kept at substantially the same value, and growing the seed crystals. In this process of grain growth, the silver solutions and halogen solutions are preferably added such that no new crystal nuclei are produced.

The size of the tabular silver halide grains can be controlled by controlling the temperature, selecting the type and the quality of a solvent, and controlling the addition rates of a silver salt and a halide used in the grain growth.

In the present invention, the grain size, the grain shape (e.g., the aspect ratio), the grain size distribution, and the grain growth rate can be controlled by using a silver halide solvent as needed in the preparation of the tabular silver halide grains. The use amount of the solvent is preferably $10^{-3}$ to 1.0 wt %, and most preferably $10^{-2}$ to $10^{-1}$ wt % of a reaction solution. In the present invention, as the use amount of the solvent increases, the grain size distribution is mono-dispersed to increase the growth rate. On the other hand, the grain thickness tends to increase with the increase in use amount of the solvent.

In the preparation of the tabular silver halide grains used in the present invention, it is preferable to use methods of increasing the addition rates, the addition amounts, and the addition concentrations of a silver salt solution (e.g., an aqueous $AgNO_3$ solution) and a halide solution (e.g., an aqueous KBr solution) to be added to accelerate the grain growth. These methods are described in, e.g., U.S. Pat. Nos. 1,335,925, 3,650,757, 3,672,900, and 4,242,445, JP-A-55-142329, and JP-A-55-158124.

In the light-sensitive material of the present invention, a low-speed layer of each emulsion layer group contains an emulsion consisting of silver halide regular crystal grains.

Examples of the regular crystal grains used in the present invention, including this low-speed layer, are cubic grains constituted by (100) faces, octahedral grains constituted by (111) faces, dodecahedral grains disclosed in JP-B-55-42737 ("JP-B" means Published Examined Japanese Patent Application) and JP-A-60-22842, and spherical grains disclosed in JP-A-57-182730, JP-A-59-179344, and JP-A-59-178447. It is also possible to use an (h11) face grain represented by a (211) face grain, an (hh1) face grain represented by a (331) face grain, an (hk0) face grain represented by a (210) face grain, and an (hk1) face grain represented by a (321) face grain, as reported in Journal of Imaging Science, vol. 30, page 247, 1986, although the method of preparation requires some improvements. A grain having two or more different faces, such as a tetradecahedral grain having both (100) faces and (111) faces or a grain having both (100) faces and (110) faces, can also be used.

Of these regular crystal grains, the cubic, octahedral, and tetradecahedral grains can be preferably used, and the cubic grain is most preferable among other grains.

The silver halide grain contained in the regular crystal silver halide emulsion of the present invention preferably has at least the core and the outermost shell.

The silver iodide content of the entire grain can be controlled by the ratios of the core, the intermediate shell, and the outermost shell and their respective silver iodide contents. The silver iodide content of the entire grain is preferably 10 mol % or less, more preferably 5 mol % or less, and most preferably 3 mol % or less.

The regular crystal grains of the present invention are preferably monodisperse. The monodisperse silver halide grains are those in which the variation coefficient of grain size, defined by $\Sigma n_i r_i / \Sigma n_i$, is 20% or less.

The grain size is the diameter of a grain, for spherical silver halide grains, and is the diameter of a circle having an area equal to the projected area of a grain, for grains having shapes other than a sphere.

A low-speed layer containing a silver halide emulsion consisting of the regular crystal grains according to the present invention can also contain another regular crystal emulsion or a twinning emulsion.

Selenium compounds disclosed in various literature can be used as selenium sensitizers for use in the present invention. That is, unstable selenium compounds and/or non-unstable selenium compounds are normally used by adding them to an emulsion and stirring the emulsion at a high temperature, preferably 40° C. or more for a predetermined time. Preferable examples of the unstable selenium compound are described in JP-B-44-15748, JP-B-43-13489, JP-A-4-25832 and JP-A-4-109240. Practical examples of the unstable selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro- 2,6-dimethoxybenzoyl)selenide), selenophosphates, phosphineselenides, and colloidal metal selenium.

Although preferable examples of the unstable selenium compound are described above, the present invention is not limited to these examples. It is generally agreed by those skilled in the art that the structure of an unstable selenium compound used as a sensitizer for a photographic emulsion is not so important as long as selenium is unstable, and that the organic part of a molecule of the selenium sensitizer has no important role except the role of carrying selenium and keeping it in an unstable state in an emulsion. In the present invention, therefore, unstable selenium compounds in this extensive concept are advantageously used.

Examples of the non-unstable selenium compound used in the present invention are those described in JP-B-46-4553, JP-B-52-34492, and JP-B-52-34491. Specific examples of the non-unstable selenium compound are selenious acid, potassium selenocyanide, selenazoles, quaternary salts of selenazoles, diarylselenide, diaryldiselenide, dialkylselenide, dialkyldiselenide, 2-selenazolidinedione, 2-selenoxazolidinethione, and derivatives of these compounds.

Among other selenium compounds, those preferably used in the present invention are compounds represented by Formulas (I) and (II) below.

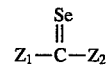

Formula (I)

wherein $Z_1$ and $Z_2$ may be the same or different and each represents an alkyl group (e.g., methyl, ethyl, t-butyl, adamantyl, and t-octyl), an alkenyl group (e.g., vinyl and propenyl), an aralkyl group (e.g., benzyl and phenethyl), an aryl group (e.g., phenyl, pentafluorophenyl, 4-chlorophenyl, 3-nitrophenyl, 4-octylsulfamoylphenyl, and α-naphthyl), a heterocyclic group (e.g., pyridyl, thienyl, furyl, and imidazolyl), $—NR_1(R_2)$, $—OR_3$, or $—SR_4$.

$R_1$, $R_2$, $R_3$, and $R_4$ may be the same or different and each represents an alkyl group, an aralkyl group, an aryl group, or a heterocyclic group. Examples of the alkyl group, the aralkyl group, the aryl group, and the heterocyclic group can be the same as those enumerated above for $Z_1$.

Note that each of $R_1$ and $R_2$ can be a hydrogen atom or an acyl group (e.g., acetyl, propanoyl, benzoyl, heptafluorobutanoyl, difluoroacetyl, 4-nitrobenzoyl, α-naphthoyl, and 4-trifluoromethylbenzoyl).

In Formula (I), $Z_1$ preferably represents an alkyl group, an aryl group, or $—NR_1(R_2)$ and $Z_2$ preferably represents $—NR_5(R_6)$ wherein $R_1$, $R_2$, $R_5$, and $R_6$ may be the same or different and each represents a hydrogen atom, an alkyl group, an aryl group, or an acyl group.

More preferable examples of a selenium compound represented by Formula (I) are N,N-dialkylselenourea, N,N,N'-trialkyl-N'-acylselenourea, tetraalkylselenourea, N,N-dialkyl-arylselenoamide, and N-alkyl-N-arylarylselenoamide.

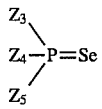

Formula (II)

wherein $Z_3$, $Z_4$, and $Z_5$ may be the same or different and each represents an aliphatic group, an aromatic group, a heterocyclic group, —$OR_7$, —$NR_8(R_9)$, —$SR_{10}$, —$SeR_{11}$, X, or a hydrogen atom.

Each of $R_7$, $R_{10}$, and $R_{11}$ represents an aliphatic group, an aromatic group, a heterocyclic group, a hydrogen atom, or a cation, and each of $R_8$ and $R_9$ represents an aliphatic group, an aromatic group, a heterocyclic group, or a hydrogen atom. X represents a halogen atom.

In Formula (II), an aliphatic group represented by $Z_3$, $Z_4$, $Z_5$, $R_7$, $R_8$, $R_9$, $R_{10}$, or $R_{11}$ represents a straight chain, branched, or cyclic alkyl, alkenyl, alkinyl, or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, and phenethyl).

In Formula (II), an aromatic group represented by $Z_3$, $Z_4$, $Z_5$, $R_7$, $R_8$, $R_9$, $R_{10}$, or $R_{11}$ represents a monocyclic or condensed ring aryl group (e.g., phenyl, pentafluorophenyl, 4-chlorophenyl, 3-sulfophenyl, α-naphthyl, and 4-methylphenyl).

In Formula (II), a heterocyclic group represented by $Z_3$, $Z_4$, $Z_5$, $R_7$, $R_8$, $R_9$, $R_{10}$, or $R_{11}$ represents a 3- to 10-membered saturated or unsaturated heterocyclic group (e.g., pyridyl, thienyl, furyl, thiazolyl, imidazolyl, and benzimidazolyl) containing at least one of a nitrogen atom, an oxygen atom, and a sulfur atom.

In Formula (II), if each of $R_7$, $R_{10}$, and $R_{11}$ represents a cation, examples of the cation are an alkali metal atom and ammonium, and, if X represents a halogen atom, examples of the halogen atom are a fluorine atom, a chlorine atom, a bromine atom, and an iodine atom.

In Formula (II), $Z_3$, $Z_4$, or $Z_5$ preferably represents an aliphatic group, an aromatic group, or —$OR_7$, and $R_7$ preferably represents an aliphatic group or an aromatic group.

More preferable examples of a compound represented by Formula (II) are trialkylphosphineselenide, triarylphosphineselenide, trialkylselenophosphate, and triarylselenophosphate.

Practical examples of compounds represented by Formulas (I) and (II) are presented below, but the present invention is not limited to these examples.

1. 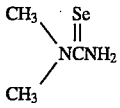

2. 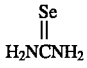

3. 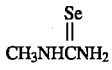

4. 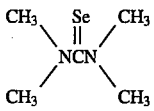

-continued

5. 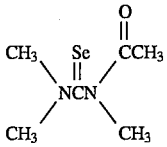

6. 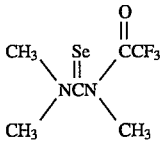

7. 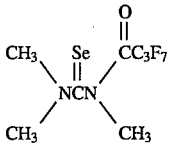

8. 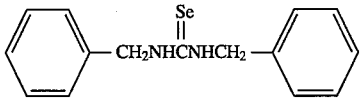

9. 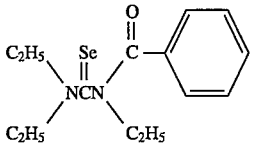

10. 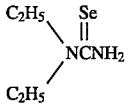

11. 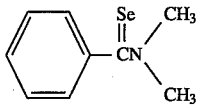

12. 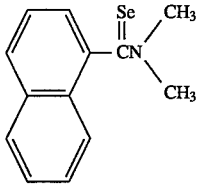

13. 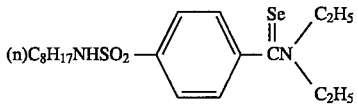

14. 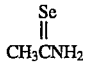

15. 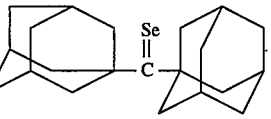

16. 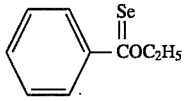

17. 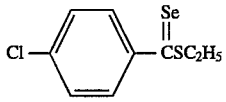

-continued

18. 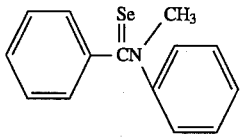

19. 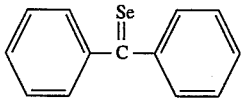

20. 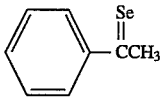

21. 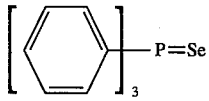

22. 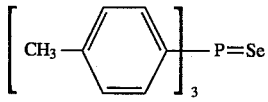

23. $(nC_4H_9)_3P{-}Se$

24. 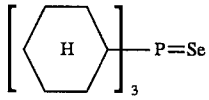

25. 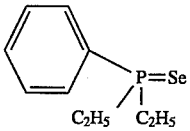

26. 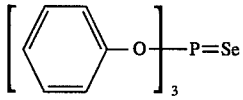

27. 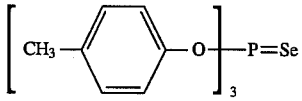

28. $(nC_4H_9O)_3P{=}Se$

29. 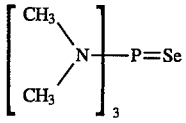

30. $(C_2H_5O)_3P{=}Se$

31. 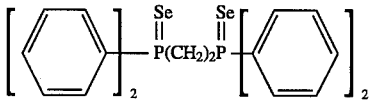

32. $(nC_8H_{17})_3P{=}Se$

33. 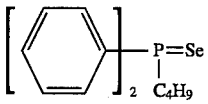

-continued

34. 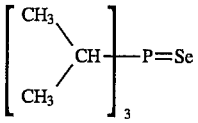

35. 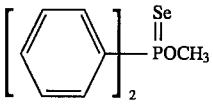

36. 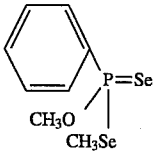

37. 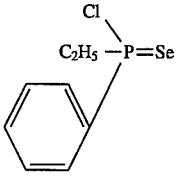

38. 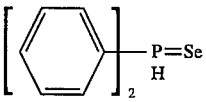

39. 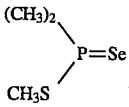

These selenium sensitizers are dissolved in any of water, an organic solvent, such as methanol or ethanol, and a solvent mixture of these organic solvents, and the resultant solution is added during chemical sensitization of an emulsion. Alternatively, the selenium sensitizers are added in the forms described in JP-A-4-140738 and JP-A-140739 during chemical sensitization of an emulsion. The addition is preferably performed before chemical sensitization of an emulsion. A selenium sensitizer used is not limited to one, but two or more of the selenium sensitizers described above can be used together. It is also possible to use the unstable and non-unstable selenium compounds together.

The addition amount of the selenium sensitizers used in the present invention changes in accordance with the activity of each selenium sensitizer used, the type or grain size of a silver halide, and the temperature and time of ripening. The addition amount, however, is preferably $1\times10^{-8}$ mol or more, and more preferably $1\times10^{-7}$ to $1\times10^{-5}$ mol per mol of a silver halide. When the selenium sensitizers are used, the temperature of chemical ripening is preferably 45° C. or more, and more preferably 50° C. to 80° C. The pAg and the pH can take any given values. As an example, the effect of the present invention can be obtained over a broad range of pH from 4 to 9.

The selenium sensitization in the present invention can be performed more effectively in the presence of a silver halide solvent.

Examples of the silver halide solvent usable in the present invention are (a) organic thioethers described in, e.g., U.S. Pat. Nos. 3,271,157, 3,531,289, and 3,574,628, JP-A-54-1019, and JP-A-54-158917, (b) thiourea derivatives described in JP-A-53-82408, JP-A-55-77737, and JP-A-55-2982, (c) a silver halide solvent having a thiocarbonyl group sandwiched between an oxygen or sulfur atom and a nitrogen atom described in JP-A-53-144319, (d) imidazoles described in JP-A-54-100717, (e) sulfite, and (f) thiocyanate.

Examples of the solvent most preferable for the selenium sensitization are thiocyanate and tetramethylthiourea. Although the amount of the solvent to be used changes in accordance with its type, a preferable amount of, e.g., thiocyanate is $1\times10^{-4}$ to $1\times10^{-2}$ mol per mol of a silver halide.

A higher sensitivity and a lower fog can be achieved by performing sulfur sensitization and/or gold sensitization, in the chemical sensitization, for the silver halide photographic emulsions used in the light-sensitive material of the present invention.

The sulfur sensitization is normally performed by adding a sulfur sensitizer to an emulsion and stirring the resultant emulsion at a high temperature of preferably 40° C. or more for a predetermined time.

Similarly, the gold sensitization is performed by adding a gold sensitizer to an emulsion and stirring the resultant emulsion at a high temperature of preferably 40° C. or more for a predetermined time.

Sulfur sensitizers known to those skilled in the art can be used in the sulfur sensitization. Examples of the sulfur sensitizer are thiosulfate, thioureas, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016. The addition amount of the sulfur sensitizer need only be one that can effectively increase the sensitivity of an emulsion. Although this amount changes over a wide range in accordance with various conditions, such as a pH, a temperature, and the size of silver halide grains, it is preferably $1\times10^{-7}$ to $5\times10^{-4}$ mol per mol of a silver halide.

The gold sensitizer for use in the gold sensitization can be any compound having an oxidation number of gold of +1 or +3, and it is possible to use gold compounds normally used as a gold sensitizer. Representative examples of the gold sensitizer are chloroaurate, potassium chloroaurate, auric-trichloride, potassium auricthiocyanate, potassium iodoaurate, tetracyanoauric acid, ammonium aurothiacyanate, and pyridyltrichlorogold.

Although the addition amount of the gold sensitizer changes in accordance with various conditions, it is preferably $1\times10^{-7}$ to $5\times10^{-4}$ mol per mol of a silver halide.

In chemical ripening, it is not particularly necessary to limit the addition timings and the addition order of the silver halide solvents and the selenium sensitizers, or the sulfur sensitizers and/or the gold sensitizers usable together with the selenium sensitizers. For example, the above compounds can be added simultaneously or at different addition timings in (preferably) the initial stage of or during the chemical ripening. The above compounds are dissolved in water, an organic solvent mixable with water, such as methanol, ethanol, or acetone, or a solvent mixture of these organic solvents, and the resultant solution is added to an emulsion.

The silver halide emulsions of the present invention are preferably subjected to reduction sensitization during grain formation, after grain formation and before chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion preparing conditions, a preferable amount is $10^{-7}$ to $10^{-3}$ mol per mol of a silver halide.

The reduction sensitizers are dissolved in, e.g., water or an organic solvent, such as alcohols, glycols, ketones, esters, or amides, and the resultant solution is added during grain growth. Although adding the reduction sensitizers to a reactor vessel in advance is also preferable, adding them at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion thus produced may form a silver salt hardly soluble in water, such as a silver halide, silver sulfide, or silver selenide, or a silver salt readily soluble in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers of the present invention are ozone, hydrogen peroxide and its adduct, a halogen element, an inorganic oxidizer such as a thiosulfonate salt, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

Photographic emulsions for use in the present invention may contain various compounds in order to prevent fog during the manufacturing process, storage, or photographic processing of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxysubstituted( 1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methane dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, and a quinoline nucleus. These nuclei may have a substitute on a carbon atom.

It is possible for a merocyanine dye or a composite merocyanine dye to have a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

The emulsions used in the present invention may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds described above can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount of the spectral sensitizing dye may be $4\times10^{-6}$ to $8\times10^{-3}$ mol per mol of a silver halide. However, for a more preferable silver halide grain size of 0.2 to 1.2 μm, an addition amount of about $5\times10^{-5}$ to $2\times10^{-3}$ mol per mol of a silver halide is more effective.

Although the various additives described above can be used in the light-sensitive material according to the present invention, a variety of other additives can also be used in accordance with the intended use.

The details of these additives are described in Research Disclosures No. 17643 (December, 1978), No. 18716 (November, 1979), and No. 308119 (December, 1989), and these portions are summarized in the following table.

TABLE

| Additives | RD17643 | RD18716 |
|---|---|---|
| 1. Chemical sensitizers | page 23 | page 648, right column |
| 2. Sensitivity-increasing agents | | page 648, right column |
| 3. Spectral sensitizers, super sensitizers | pages 23–24 | page 648, right column to page 649, right column |
| 4. Brighteners | page 24 | page 648, right column |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain-preventing agents | page 25, right column | page 650, left to right columns |
| 8. Dye image-stabilizer | page 25 | page 650, left column |
| 9. Hardening agents | page 26 | page 651, left column |
| 10. Binder | page 26 | page 651, left column |
| 11. Plasticizers, lubricants | page 27 | page 650, right column |

TABLE-continued

| | | |
|---|---|---|
| 12. Coating aids, surface active agents | pages 26–27 | page 650, right column |
| 13. Antistatic agents | page 27 | page, 650, right column |
| 14. Matting agents | | |

| Additives | RD308119 |
|---|---|
| 1. Chemical sensitizers | page 996 |
| 2. Sensitivity-increasing agents | |
| 3. Spectral sensitizers, super sensitizers | page 996, right column to page 998, right column |
| 4. Brighteners | page 998, right column |
| 5. Antifoggants and stabilizers | page 998, right column to page 1,000, right column |
| 6. Light absorbent, filter dye, ultraviolet absorbents | page 1,003, left column to page 1,003, right column |
| 7. Stain-preventing agents | page 1,002, right column |
| 8. Dye image-stabilizer | " |
| 9. Hardening agents | page 1,004, right column to page 1,005, left column |
| 10. Binder | page 1,003, right column to page 1,004, right column |
| 11. Plasticizers, lubricants | page 1,006, left column to page 1,006, right columns |
| 12. Coating aids, surface active agents | page 1,005, left column to page 1,006, left column |
| 13. Antistatic agents | page 1,006, right column to page 1,007, left column |
| 14. Matting agents | page 1,008, left column to page 1,009, left column |

In the light-sensitive material of the present invention, a specific photographic sensitivity defined below must be 100 or more, preferably 320 or more, and more preferably 320 to 3,200.

Note that in the present invention, the specific photographic sensitivity described in detail and defined below is adopted as the sensitivity of a photographic light-sensitive material for the reasons explained below.

That is, an ISO sensitivity as an international standard is generally used as the sensitivity of a photographic light-sensitive material. The ISO sensitivity, however, is a sensitivity obtained by developing a light-sensitive material on the fifth day after exposure, and it is defined that the development is based on processing designated by each individual company. The present invention, therefore, adopts the specific photographic sensitivity defined below in order to shorten a time from exposure to development (to 0.5 to 6 hours) and make it possible to determine sensitivity by predetermined development.

The specific photographic sensitivity for the light-sensitive material of the present invention is determined in accordance with the following test method corresponding to the ISO sensitivity. (The method is based on JIS K7614-1981.)

(1) Test Conditions

The test is performed in a room at a temperature of 20° C.±5° C. and a relative humidity of 60%±10%. A light-sensitive material to be tested is left to stand under these conditions for one hour or more and then subjected to exposure and each processing.

(2) Exposure

1. A relative spectral energy distribution of reference light on an exposure surface is as shown in Table A below.

TABLE A

| Wave-length, nm | Relative spectral energy note 1 | Wavelength, nm | Relative spectral energy note 1 |
|---|---|---|---|
| 360 | 2 | 540 | 102 |
| 370 | 8 | 550 | 103 |
| 380 | 14 | 560 | 100 |
| 390 | 23 | 570 | 97 |
| 400 | 45 | 580 | 98 |
| 410 | 57 | 590 | 90 |
| 420 | 63 | 600 | 93 |
| 430 | 62 | 610 | 94 |
| 440 | 81 | 620 | 92 |
| 450 | 93 | 630 | 88 |
| 460 | 97 | 640 | 89 |
| 470 | 98 | 650 | 86 |
| 480 | 101 | 660 | 86 |
| 490 | 97 | 670 | 89 |
| 500 | 100 | 680 | 85 |
| 510 | 101 | 690 | 75 |
| 520 | 100 | 700 | 77 |
| 530 | 104 | | |

Note 1: A value determined assuming that the value at 560 nm is 100.

2. An intensity change on an exposure surface is caused using an optical wedge. In this optical wedge used, a variation in spectral transmission density falls within a wavelength range of 360 to 700 nm in any portion and said variation is within 10% in a region at less than 400 nm and within 5% in a region at 400 nm or more.

3. An exposure time is 1/100.

(3) Development

1. From exposure to development, a light-sensitive material to be tested is kept at a temperature of 20° C.±5° C. and a relative humidity of 60%±10%.

2. Development is completed within a time period from 30 minutes after exposure to six hours.

3. Development is performed as follows.

| | | |
|---|---|---|
| Color development | 3 min 15 sec, | 38.0° C. ± 0.1° C. |
| Bleaching | 7 min 0 sec, | 38.0° C. ± 3.0° C. |
| Washing | 3 min 15 sec, | 24° C. to 41° C. |
| Fixing | 6 min 30 sec, | 38.0° C. ± 3.0° C. |
| Washing | 3 min 15 sec, | 24° C. to 41° C. |
| Stabilization | 3 min 15 sec, | 38.0° C. ± 3.0° C. |
| Drying | 5 min | 55° C. or less |

The compositions of the processing solutions used in the individual steps are shown below.

| Color developing solution | |
|---|---|
| Diethylenetriaminepentaacetic acid | 1.0 g |
| 1-hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-β-hydroxylethylamino)-2-methylaniline sulfate | 4.5 g |
| Water to make | 1.0 l |
| pH | 10.0 |

| Bleaching solution | |
|---|---|
| Ferric ammonium ethylenediamine tetraacetate | 100.0 g |
| Disodium ethylenediamine tetraacetate | 10.0 g |
| Ammonium bromide | 150.0 g |

-continued

| | |
|---|---|
| Ammonium nitrate | 10.0 g |
| Water to make | 1.0 l |
| pH | 6.0 |

Fixing solution

| | |
|---|---|
| Disodium ethylenediamine tetraacetate | 1.0 g |
| Ammonium sulfite | 4.0 g |
| Ammonium thiosulfate aqueous solution (70%) | 175.0 ml |
| Sodium bisulfite | 4.6 g |
| Water to make | 1.0 l |
| pH | 6.6 |

Stabilizing solution

| | |
|---|---|
| Formalin (40%) | 2.0 ml |
| Polyoxyethylene-p-monononylphenylether (average polymerization degree 10) | 0.3 g |
| Water to make | 1.0 l |

A density is represented by $\log_{10}(\Phi_0/\Phi)$. $\Phi_0$ represents a lighting-luminous flux for density measurement; and $\Phi$, a luminous flux transmitted through a portion to be measured. The geometric conditions of density measurement are that the lighting-luminous flux is a parallel-luminous flux in the normal direction and the transmission-luminous flux is a full lighting-luminous flux transmitted and diffused in a half space. If another measurement direction is to be used, correction is performed by using a standard density piece. In the measurement, the surface of an emulsion film is opposed to a light-receiving device. The density measurement is performed for status M densities of blue, green, and red, and the spectral characteristics are set to take values listed in Table B below as total characteristics of a light source, an optical system, an optical filter, and a light-receiving device used in a densitometer.

TABLE B (Logarithm indication: reference ratio to peak 5.00)

| Wave-length, nm | Blue | Green | Red | Wave-length, nm | Blue | Green | Red |
|---|---|---|---|---|---|---|---|
| 400 | * | * | * | 580 | ** | 3.90 | * |
| 410 | 2.10 | * | * | 590 | ** | 3.15 | * |
| 420 | 4.11 | * | * | 600 | ** | 2.22 | * |
| 430 | 4.63 | * | * | 610 | ** | 1.05 | * |
| 440 | 4.37 | * | * | 620 | ** | ** | 2.11 |
| 450 | 5.00 | * | * | 630 | ** | ** | 4.48 |
| 460 | 4.95 | * | * | 640 | ** | ** | 5.00 |
| 470 | 4.74 | 1.13 | * | 650 | ** | ** | 4.90 |
| 480 | 4.34 | 2.19 | * | 660 | ** | ** | 4.58 |
| 490 | 3.74 | 3.14 | * | 670 | ** | ** | 4.25 |
| 500 | 2.99 | 3.79 | * | 680 | ** | ** | 3.88 |
| 510 | 1.35 | 4.25 | * | 690 | ** | ** | 3.49 |
| 520 | ** | 4.61 | * | 700 | ** | ** | 3.10 |
| 530 | ** | 4.85 | * | 710 | ** | ** | 2.69 |
| 540 | ** | 4.98 | * | 720 | ** | ** | 2.27 |
| 550 | ** | 4.98 | * | 730 | ** | ** | 1.86 |
| 560 | ** | 4.80 | * | 740 | ** | ** | 1.45 |
| 570 | ** | 4.44 | * | 750 | ** | ** | 1.05 |

*: Red slope 0.260/nm, green slope 0.106/nm, and blue slope 0.250/nm.
**: Red slope 0.040/nm, green slope 0.120/nm, and blue slope 0.220/nm.

(5) Determination of Specific Photographic Sensitivity

The specific photographic sensitivity is determined by using the results of density measurement processed under the conditions described in item (1) to (4) above in accordance with the following procedure.

1. Exposure amounts corresponding to densities higher by 0.15 than the minimum densities of blue, green, and red are represented in lux·sec as $H_B$, $H_G$, and $H_R$, respectively.
2. A larger (lower-sensitivity) one of $H_B$ and $H_R$ is taken as $H_S$.
3. A specific photographic sensitivity S is calculated in accordance with the following relation:

Relation $$S=\sqrt{\frac{2}{H_G \times H_S}}$$

The specific photographic sensitivity defined by the above method of the light-sensitive material of the present invention is preferably 100 or more. A specific photographic sensitivity of less than 100 increases the probability of being out of focus due to opening of an aperture in normal photographing, the probability of a camera shake due to a low shutter speed, and the probability of insufficient exposure, resulting in a high possibility of failures. In addition, many of recent cameras have an automatic setting function of sensitivity performed by reading DX codes, and many inexpensive cameras so-called compact cameras are unable to set a sensitivity less than ISO 100. Therefore, light-sensitive materials other than those having an ISO sensitivity of 100 or more are difficult to apply to these cameras.

In the development of the silver halide color light-sensitive material of the present invention, a method of continuously processing while replenishing a developing solution is preferably used.

In this development, the quantity of replenisher of a color developing solution is 500 ml or less per 1 $m^2$. However, a range over which the effect of the present invention is more significant is preferably 100 to 500 ml, more preferably 400 ml or less, and most preferably 300 ml or less.

A color developing agent using in a color developing solution and a color developing replenisher is an aromatic primary amine compound including known compounds widely used in various color photography processes. In the present invention, however, the color developing agent is preferably an N,N-dialkyl-p-phenylenediamine color developing agent, such as those described in (1) to (6) below.

(1) 4-(N-ethyl-N-β-hydroxyethylamino)-2-methylaniline sulfate
(2) 4-(N-ethyl-N-β-methanesulfonamidoethylamino)- 2-methylaniline sulfate
(3) 4-(N-ethyl-N-β-methoxyethylamino)-2-methylaniline-p-toluenesulfonate
(4) 4-(N,N-diethylamino)-2-methylaniline hydrochloride
(5) 4-(N-ethyl-N-dodecylamino)-2-methylaniline sulfate
(6) N,N-diethyl-p-phenylenediamine hydrochloride These compounds are added to a color developing solution in an amount of 0.005 to 0.05 mol/l, preferably 0.01 to 0.03 mol/l, and most preferably 0.013 to 0.02 mol/l. The concentration of the compounds is preferably higher than the above concentration in a color developing replenisher. A practical value of this high concentration depends on setting of the quantity of replenisher but is generally 1.05 to 2.0 times, preferably 1.2 to 1.8 times the concentration of a color developing solution (mother solution).

The above color developing agents can be used either singly or together in accordance with the intended use. Preferable examples of the combination are (1) and (2), (1) and (3), and (2) and (3) of the above color developing agents.

In the present invention, the bromine ion concentration of a color developing solution is preferably 0.005 to 0.02 mol/l. For this purpose, the bromide content of a replenisher is preferably set to 0.005 mol/l or less. Generally, the bromide content of a replenisher must be set low as the quantity of replenisher is decreased. Especially in the present invention, in order to largely reduce the quantity of replenisher, the bromide content of a replenisher is preferably 0.003 mol/l or less. Most preferably, a replenisher does not contain any bromide.

Examples of the bromide are potassium bromide, sodium bromide, lithium bromide, and hydrobromic acid.

A color developing solution and a color developing replenisher contain preservatives, such as hydroxylamine, diethylhydroxylamine, triethanolamine, compounds described in West German Patent (OLS) 2,622,950, hydrazines described in JP-A-63-146041, sulfite, and hydrogensulfite.

A color developing solution and a color developing replenisher are also added with various chelating agents for the purpose of water softening or metal masking.

A color developing solution for use in the present invention may contain a pH buffering agent, such as carbonate, borate, and phosphate of an alkari metal; a development inhibitor or an antifoggant, such as iodide, benzimidazoles, benzothiazoles, and a mercapto compound; an organic solvent, such as diethyleneglycol; a development accelerator, such as benzylalcohol, polyethyleneglycol, quaternary ammonium, amines, and thiocyanate; a nucleating agent, such as sodium borohydride; an auxiliary developing agent, such as 1-phenyl-3-pyrazolidone; a viscosity imparting agent; and various chelating agents represented by aminopolycarboxylic acid, aminopolyphosphonic acid, alkylphosphonic acid, and phosphonocarboxylic acid, e.g., ethylenediaminetetraacetic acid, nitrilotriacetic acid, cyclohexanediaminetetraacetic acid, iminodiacetic acid, hydroxyethyliminodiacetic acid, and organic phosphonic acid described in Research Disclosure 18170 (May, 1979). These chelating agents can be used singly or in a combination of two or more of them.

In the present invention, the pH values of a color developing solution and its replenisher are normally 9 or more, preferably 9.5 to 12, and most preferably 9.5 to 11.0. Within these ranges, the pH of a replenisher is preferably set to be higher by about 0.05 to 0.5 than that of a color developing solution.

The temperature of the color development is 30° to 45° C. To achieve better low-replenishment processing, however, higher temperatures are preferable. In the present invention, the color development is performed at preferably 35° to 45° C., and most preferably 38° to 42° C.

Although the development for the light-sensitive material of the present invention can be performed either manually or by using an automatic developing machine, the development using an automatic developing machine is preferable. In the processing using an automatic developing machine, either a single or a plurality of color developing solution tanks may be used. However, the use of a multi-stage forward-current replenishing scheme, in which a plurality of tanks are used to flow a replenisher from the forefront tank to the subsequent tanks in sequence, can further reduce the quantity of replenisher. In addition, the contact area between a developing solution in each tank and air is preferably as small as possible. More specifically, the use of a floating cover, sealing using a high-boiling liquid with a specific gravity lower than that of a developing solution, or shielding means, such as a tank structure having a converged opening portion described in JP-A-63-216050, can further enhance the effect of the present invention.

In addition, as a means for enhancing the effect of the present invention, in order to compensate for concentration of a developing solution due to evaporation, it is preferable to replenish water corresponding to the amount of evaporation. Water to be replenished is preferably deionized water subjected to ion exchange processing or deionized water subjected to processing, such as reverse osmosis or distillation.

A color developing solution and a color developing replenisher are prepared by sequentially dissolving the chemicals described above to a predetermined amount of water. This water for preparation is preferably the deionized water described above.

In the present invention, a light-sensitive material subjected to color development is processed by a processing solution with a bleaching power. The processing solution with a bleaching power includes a so-called bleaching solution and a bleach-fixing solution also having a fixing power.

Representative examples of a desilvering process using these bleaching solution, bleach-fixing solution, and fixing solution in the present invention are as follows.

1. Bleaching→fixing
2. Bleaching→bleach-fixing
3. Bleaching→washing→fixing
4. Rinsing→bleaching→fixing
5. Bleaching→bleach-fixing→fixing
6. washing→bleach-fixing The process 1, 2, and 5 are most preferable among other processes. The step 2 is disclosed in, e.g., JP-A-61-75352.

In the present invention, at least one processing solution (preferably a bleaching solution) having a bleaching power need only contain a bleaching agent with an oxidation-reduction potential of 150 mV or more. Therefore, if two or more processing solutions with a bleaching power are to be used, the second processing solution (e.g., a bleach-fixing solution) with a bleaching power may be a known bleaching agent (e.g., iron(III) ethylenediaminetetraacetate complex salt, iron(III) diethylenetriaminepentaacetate complex salt, and iron(III) trans-1,2-cyclohexanediaminetetraacetate complex salt). The second processing solution may contain any of these bleaching agents.

In the present invention, a bleaching agent as an oxidizer contained in the processing solution with a bleaching power has an oxidation-reduction potential of 150 mV or more, preferably 180 mV or more, more preferably 200 mV or more, and most preferably 230 mV or more.

The oxidation-reduction potential of a bleaching agent is defined by an oxidation-reduction potential obtainable by a measurement performed by the method described in Transactions of the Feraday Society, Vol. 55 (1959), pages 1,312 and 1,313.

The oxidation-reduction potential in this case is obtained by the above method under a condition of pH 6.0.

Various bleaching accelerators can be added to the solution with a bleaching power or a pre-bath of the solution. Examples of such a bleaching accelerator are compounds having a mercapto group or a disulfide group, described in U.S. Pat. No. 3,893,858, German Patent 1,290,812, British Patent 1,138,842, JP-A-53-95630, and Research Disclosure No. 17129 (July, 1978); a thiazolidine derivative described in JP-A-50-140129; a thiourea derivative described in U.S. Pat. No. 3,706,561; iodide described in JP-A-58-16235; polyethyleneoxides described in German Patent 2,748,430; and a polyamine compound described in JP-B-45-8836. The mercapto compound as described in British Patent 1,138,842 is most preferable among other compounds.

The solution with a bleaching power can further contain a rehalogenating agent in addition to the bleaching agent and the above compounds. Examples of the rehalogenating agent are bromide, such as potassium bromide, sodium bromide, and ammonium bromide, and chloride, such as potassium chloride, sodium chloride, and ammonium chloride. The concentration of the rehalogenating agent is 0.1 to 5 mols, preferably 0.5 to 3 mols per liter of the solution with a bleaching power.

In addition, it is preferable to use ammonium nitrate as a metal corrosion inhibitor.

If the solution with a bleaching power is a bleach-fixing solution, this bleach-fixing solution can contain a compound, such as a fixing agent or a preservative, that can be added to a fixing solution as will be described later.

The processing time using the processing solution with a bleaching power is 120 seconds or less, preferably 60 seconds or less, and more preferably 50 seconds or less. The present invention becomes more effective when the processing time is thus shortened.

Note that it is preferable to perform aeration for the solution with a bleaching power containing iron(III) aminopolycarboxylate complex salt so that iron(III) aminopolycarboxylate complex salt produced is oxidized.

In the present invention, when a light-sensitive material is bleached by a bleaching solution, the material is then normally processed by using a processing solution with a fixing power.

Examples of such a processing solution are a fixing solution and a bleach-fixing solution, and the solution contains a fixing agent.

Examples of the fixing agent are thiosulfate, such as sodium thiosulfate, ammonium thiosulfate, sodium ammonium thiosulfate, and potassium thiosulfate, thiocyanate (rhodanate), such as sodium thiocyanate, ammonium thiocyanate, and potassium thiocyanate, thiourea, and thioether.

Among those compounds, thiosulfate, particularly ammonium thiosulfate is preferred. Depending on the type of a light-sensitive material, the use of both thiosulfate and thiocyanate is preferred. In this case, a combination of ammonium thiosulfate and ammonium thiocyanate is more preferable.

When thiosulfate is to be used singly as a fixing agent, the amount of thiosulfate is 0.3 to 3 mols, preferably about 0.5 to 2 mols per liter of a fixing solution or a bleach-fixing solution. When thiocyanate is to be used together with thiosulfate, the amount of thiocyanate is ½ to twice (molar ratio) that of thiosulfate.

Examples of a compound other than thiocyanate, that can be used together with thiosulfate (particularly ammonium thiosulfate), are thiourea and thioether (e.g., 3,6-dithia-1,8-octanediol).

Although the amount of these compounds is generally about 0.01 to 0.1 mol per liter of a fixing solution or a bleach-fixing solution, 1 to 3 mols of these compounds are used in some cases.

A fixing solution or a bleach-fixing solution can contain sulfite (e.g., sodium sulfite, potassium sulfite, and ammonium sulfite) as a preservative, hydroxylamine, hydrazine, and a bisulfite adduct of an aldehyde compound, e.g., sodium acetaldehyde bisulfite. In addition, the fixing solution or the bleach-fixing solution may contain various fluorescent brighteners, anti-foaming agents, surfactants, polyvinylpyrrolidone, and an organic solvent such as methanol. As the preservative, the use of a sulfinic acid compound described in JP-A-62-143048 is preferred.

The pH of the fixing solution is preferably 5 to 9, and more preferably 7 to 8. The pH of the bleach-fixing agent, when used subsequently to the bleaching solution containing a bleaching agent with an oxidation-reduction potential of 150 mV or more as described above, is preferably 5.0 to 8.5, and more preferably 6.0 to 7.5.

When a replenishing scheme is used, the quantity of replenisher of the fixing solution or the bleach-fixing solution used subsequently to the bleaching processing is preferably 300 to 3,000 ml, and more preferably 300 to 1,000 ml per 1 $m^2$ of a light-sensitive material.

In addition, it is preferable to add various aminopolycarboxylic acids or organic sulfonic acids to the fixing solution and the bleach-fixing solution for the purpose of stabilizing the solutions.

The total processing time of the fixing processing or the bleach-fixing processing performed after the bleaching processing is preferably 30 seconds to two minutes, more preferably one minute and 45 seconds or less, and most preferably one minute and 30 seconds or less.

The processing temperature of the bleaching solution, the bleach-fixing solution, and the fixing solution is 25° to 50° C., preferably 35° to 45° C.

The processing method of the present invention is constituted by the processes of color development, bleaching, bleach-fixing, and fixing as described above. In this method, processing processes, such as washing and stabilization, are commonly performed after the bleach-fixing or fixing step. It is, however, also possible to perform a simple processing method in which stabilization is performed after a bath having a fixing power without essentially performing washing.

washing water used in the washing step may contain known additives as needed. Examples of the additives are water softeners, such as inorganic phosphoric acid, aminopolycarboxylic acid, and organic phosphoric acid, germicides for preventing multiplication of bacteria or algae, antifungal agents (e.g., isothiazolone, an organic chlorine germicide, and benzotriazole), and surfactants for preventing a drying load and unevenness. In addition, compounds described in, e.g., L. E. West, "Water Quality Criteria," Phot. Sci. and Eng., Vol. 9, No. 6, pages 344 to 359 (1965) can also be used.

As a stabilizing solution for use in the stabilization step, a processing solution for stabilizing dye images is used. Examples of the stabilizing solution are a solution having a buffering power of pH 3 to 6 and a solution containing aldehyde (e.g., formalin). The stabilizing solution may contain an ammonium compound, a metal compound of Bi or Al, a fluorescent brightener, a chelating agent (e.g., 1-hydroxyethylidene-1,1-diphosphonic acid), a germicide, an antifungal agent, a hardener, a surfactant, and alkanolamine as needed.

The washing or stabilization step is preferably performed by a multi-stage counter-current scheme, and the number of stages is preferably two to four. The quantity of replenisher is one to 50 times, preferably two to 30 times, and more preferably two to 15 times the quantity carried over from a pre-bath per unit area.

As water for use in the washing or stabilization process, it is preferable to use tap water, deionized water in which Ca and Mg concentrations are reduced to 5 mg/l or less by using an ion exchange resin, and water sterilized with halogen or an ultraviolet germicidal lamp.

The quantity of waste solution can be reduced by the use of a method of introducing the overflow solution in the washing or stabilization step to a bath having a fixing power as the pre-bath.

The present invention is normally carried out by using an automatic developing machine. This automatic developing machine preferably has light-sensitive material conveyor means described in JP-A-60-191257, JP-A-60-191258, and JP-A-60-191259.

As described in JP-A-60-191257, this conveyor means can significantly reduce the amount of a processing solution carried over from a pre-bath to a post-bath and hence has a startling effect of preventing degradation in performance of the processing solution. This effect is useful particularly in shortening the processing time of each step or reducing the quantity of replenisher of a processing solution.

Preferable examples of a silver halide usable together with silver halide grains, such as the tabular grains and regular crystal grains mentioned earlier, in the photographic emulsion layers of the color light-sensitive material of the present invention are silver bromoiodide, silver iodochloride, and silver bromochloroiodide, each containing about 30 mol % or less of silver iodide. A most preferable silver halide is silver bromoiodide containing about 2 mol % to about 25 mol % of silver iodide.

Silver halide grains in photographic emulsions may be any of grains having regular crystal shapes, such as cubic, octahedral, and tetradecahedral grains, grains having irregular crystal shapes, such as spherical grains, grains having crystal defects, such as those having twin planes, and grains having composite forms of these grains.

The above silver halide grains may be either fine grains with a grain size of about 0.2 μm or less or large-size grains with a projected area diameter of up to about 10 μm. The emulsion may be either a poly-disperse emulsion or a monodisperse emulsion.

Silver halide photographic emulsions usable in the present invention can be prepared by using the methods described in, e.g., Research Disclosure (RD) No. 17643 (December, 1978), pages 22 and 23, "I. Emulsion preparation and types," and RD No. 18716 (November, 1979), page 648; P. Glafkides, "Chemie et Phisique Photographique," Paul Montel, 1967; G. F. Duffin, "Photographic Emulsion Chemistry," Focal Press, 1966; and V. L. Zelikman et al., "Making and Coating Photographic Emulsion," Focal Press, 1964.

The use of monodisperse emulsions described in U.S. Pat. Nos. 3,574,628 and 3,655,394 and British Patent 1,413,748 is also preferred.

In the light-sensitive material of the present invention, the crystal structure of the silver halide grains usable together with the tabular grains or the regular crystal grains may be any of a uniform structure, a structure in which the halogen composition of the interior of a grain differs from that of its surface layer, and a phased structure. In addition, a silver halide having a different composition may be bonded by epitaxial junction. It is also possible to bond a compound other than a silver halide, such as silver rhodanide or zinc oxide. Furthermore, a mixture of grains having various crystal shapes may also be used.

Silver halide emulsions for use in the light-sensitive material of the present invention are normally subjected to physical ripening, chemical ripening, and spectral sensitization. Additives usable in these steps are described in Research Disclosure Nos. 17643 and 18716, and the corresponding portions are summarized in the following table.

Known photographic additives usable in the present invention are also described in the above two RDs, and they are summarized in the following Table:

| Additives | RD17643 | RD18716 |
|---|---|---|
| 1. Chemical sensitizers | page 23 | page 648, right column |
| 2. Sensitivity-increasing agents | | page 648, right column |
| 3. Spectral sensitizers, super-sensitizers | pp. 23–24 | page 648, right column to page 649, right column |
| 4. Brighteners | page 24 | page 648, right column |
| 5. Antifoggants, stabilizers | pp. 24–25 | page 649, right column |
| 6. Light absorbent, filter dye, ultraviolet absorbents | pp. 25–26 | page 649, right column to page 650, left column |
| 7. Stain-preventing agents | page 25, right column | page 650, left to right columns |
| 8. Dye image-stabilizer | page 25 | page 650, left column |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pp. 26–27 | page 650, right column |
| 13. Antistatic agents | page 27 | page 650, right column |

Various color couplers can be used in the present invention, and specific examples of these couplers are described in patents described in the above-mentioned RD No. 17643, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. 4,777,120 may be preferably used.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Typical examples of a polymerized dye-forming coupler are described in, e.g., U.S. Pat. Nos. 3,451,820; 4,080,211, 4,367,282; 4,409,320 and 4,576,910, British Patent 2,102, 173, and European Patent 341,188A.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840.

Examples of other compounds which can be used in the light-sensitive material of the present invention are competing couplers described in, for example, U.S. Pat. No. 4,130, 427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Further, these couplers can be dispersed in a hydrophilic colloidal solution for emulsification by being impregnated in loadable latex polymer (for example, U.S. Pat. No. 4,203, 716) in the presence of, or without, the above-mentioned high-boiling organic solvent, or dissolved in water-in-soluble-and-organic-solvent-soluble polymer.

Preferably, homopolymers or copolymers disclosed in WO088/00723, pages 12–30 are used. In particular, use of the polymers of acrylamide series is more preferable in terms of stabilization of the color image.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, and RD. No. 18716, from the right column, page 647 to the left column, page 648.

The present invention will be described in more detail below by way of its examples, but the present invention is not limited to these examples.

EXAMPLE 1

A plurality of layers having the compositions presented below were coated on an undercoated triacetylcellulose film support to make a sample 101 as a multilayered color light-sensitive material.

Compositions of Light-sensitive Layers

The main materials used in the individual layers are classified as follows.

| | |
|---|---|
| ExC: Cyan coupler | UV: Ultraviolet absorbent |
| ExM: Magenta coupler | HBS: High-boiling organic solve |
| ExY: Yellow coupler | H: Gelatin hardener |
| ExS: Sensitizing dye | |

The number corresponding to each component indicates the coating amount in units of g/m$^2$. The coating amount of a silver halide is represented by the coating amount of silver. The coating amount of each sensitizing dye is represented in units of mols per mol of a silver halide in the same layer.

(Sample 101)

| | | |
|---|---|---|
| 1st layer (Antihalation layer) | | |
| Black colloidal silver | silver | 0.18 |
| Gelatin | | 1.40 |
| ExM-1 | | 0.18 |
| ExF-1 | | $2.0 \times 10^{-3}$ |
| HBS-1 | | 0.20 |
| 2nd layer (Interlayer) | | |
| Emulsion E | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| 3rd layer (Low-speed red-sensitive emulsion layer) | | |
| Emulsion A | silver | 0.25 |
| Emulsion B | silver | 0.25 |
| ExS-1 | | $4.5 \times 10^{-4}$ |
| ExS-2 | | $1.5 \times 10^{-5}$ |

(Sample 101)

| | | |
|---|---|---|
| ExS-3 | | $4.5 \times 10^{-4}$ |
| ExC-1 | | 0.17 |
| ExC-3 | | 0.030 |
| ExC-4 | | 0.10 |
| ExC-5 | | 0.0050 |
| ExC-7 | | 0.0050 |
| ExC-8 | | 0.020 |
| Cpd-2 | | 0.025 |
| HBS-1 | | 0.10 |
| Gelatin | | 0.87 |
| 4th layer (Medium-speed red-sensitive emulsion layer) | | |
| Emulsion C | silver | 0.80 |
| ExS-1 | | $3.0 \times 10^{-4}$ |
| ExS-2 | | $1.2 \times 16^{-5}$ |
| ExS-3 | | $4.0 \times 10^{-4}$ |
| ExC-1 | | 0.15 |
| ExC-2 | | 0.060 |
| ExC-4 | | 0.11 |
| ExC-7 | | 0.0010 |
| ExC-8 | | 0.025 |
| Cpd-2 | | 0.023 |
| HBS-1 | | 0.10 |
| Gelatin | | 0.75 |
| 5th layer (High-speed red-sensitive emulsion layer) | | |
| Emulsion D | silver | 1.40 |
| ExS-1 | | $2.0 \times 10^{-4}$ |
| ExS-2 | | $1.0 \times 10^{-6}$ |
| ExS-3 | | $3.0 \times 10^{-4}$ |
| ExC-1 | | 0.095 |
| ExC-3 | | 0.040 |
| ExC-6 | | 0.020 |
| ExC-8 | | 0.007 |
| Cpd-2 | | 0.050 |
| HBS-1 | | 0.22 |
| HBS-2 | | 0.10 |
| Gelatin | | 1.20 |
| 6th layer (Interlayer) | | |
| Cpd-1 | | 0.10 |
| HBS-1 | | 0.50 |
| Gelatin | | 1.10 |
| 7th layer (Low-speed green-sensitive emulsion layer) | | |
| Emulsion A | silver | 0.17 |
| Emulsion B | silver | 0.17 |
| ExS-4 | | $4.0 \times 10^{-5}$ |
| ExS-5 | | $1.8 \times 10^{-4}$ |
| ExS-6 | | $6.5 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Emulsion C | silver | 0.80 |
| ExS-4 | | $2.0 \times 10^{-5}$ |
| ExS-5 | | $1.4 \times 10^{-4}$ |
| ExS-6 | | $5.4 \times 10^{-4}$ |
| ExM-2 | | 0.16 |
| ExM-3 | | 0.045 |
| ExY-1 | | 0.01 |
| ExY-5 | | 0.030 |
| HBS-1 | | 0.16 |

(Sample 101)

| | | |
|---|---|---|
| HBS-3 | | $8.0 \times 10^{-3}$ |
| Gelatin | | 0.90 |
| 9th layer (High-speed green-sensitive emulsion layer) | | |
| Emulsion D | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.015 |
| ExM-4 | | 0.040 |
| ExM-5 | | 0.019 |
| Cpd-3 | | 0.020 |
| HBS-1 | | 0.25 |
| HBS-2 | | 0.10 |
| Gelatin | | 1.20 |
| 10th layer (Yellow filter layer) | | |
| Yellow colloidal silver | silver | 0.010 |
| Cpd-1 | | 0.16 |
| HBS-1 | | 0.60 |
| Gelatin | | 0.60 |
| 11th layer (Low-speed blue-sensitive emulsion layer) | | |
| Emulsion A | silver | 0.25 |
| Emulsion B | silver | 0.40 |
| ExS-7 | | $8.0 \times 10^{-4}$ |
| ExY-1 | | 0.030 |
| ExY-2 | | 0.55 |
| ExY-3 | | 0.25 |
| ExY-4 | | 0.020 |
| ExC-7 | | 0.01 |
| HBS-1 | | 0.35 |
| Gelatin | | 1.30 |
| 12th layer (High-speed blue-sensitive emulsion layer) | | |
| Emulsion D | silver | 1.38 |
| ExS-7 | | $3.0 \times 10^{-4}$ |
| ExY-2 | | 0.10 |
| ExY-3 | | 0.10 |
| HBS-1 | | 0.070 |
| Gelatin | | 0.86 |
| 13th layer (1st protective layer) | | |
| Emulsion E | silver | 0.20 |
| UV-4 | | 0.11 |
| UV-5 | | 0.17 |
| HBS-1 | | $5.0 \times 10^{-2}$ |
| Gelatin | | 1.00 |
| 14th layer (2nd protective layer) | | |
| H-1 | | 0.40 |
| B-1 (diameter 1.7 μm) | | $5.0 \times 10^{-2}$ |
| B-2 (diameter 1.7 μm) | | 0.10 |
| B-3 | | 0.10 |
| S-1 | | 0.20 |
| Gelatin | | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, palladium salt, and rhodium salt.

Note that the emulsions A to E used in the above sample 101 are listed in Table 1 below.

TABLE 1

| | Average AgI content (%) | Average grain size (μm) | Variation coefficient (%) according to grain size | Diameter/ thickness ratio | Silver amount ratio [Core/intermediate/ shell] (AgI content) | Grain structure/shape |
|---|---|---|---|---|---|---|
| Emulsion | | | | | | |
| A | 1.5 | 0.30 | 10 | 1 | [1/1] (1/2) | Double structure cubic grain |
| B | 1.5 | 0.50 | 8 | 1 | [1/1] (1/2) | Double structure cubic grain |
| C | 2.8 | 0.80 | 18 | 6 | [14/56/30] (0.2/1/7.5) | Triple structure tabular grain |
| D | 2.3 | 1.10 | 16 | 6 | [6/64/30] (0.2/1/5.5] | Triple structure tabular grain |
| E | 1.0 | 0.07 | 15 | 1 | — | Uniform structure fine grain |

In Table 1, (1) The emulsions A to D were subjected to reduction sensitization during grain preparation by using thiourea dioxide and thiosulfonic acid in accordance with the Examples in JP-A-2-191938.

(2) The emulsions A to D were subjected to gold sensitization, sulfur sensitization, and selenium sensitization in the presence of the spectral sensitizing dyes described in the individual light-sensitive layers and sodium thiocyanate in accordance with the Examples in JP-A-3-237450.

(3) The preparation of tabular grains was performed by using low-molecular weight gelatin in accordance with the Examples in JP-A-1-158426.

(4) Dislocation lines as described in JP-A-3-237450 were observed in tabular grains when a high-voltage electron microscope was used.

The structures of the above compounds represented by symbols are shown below.

ExC-1

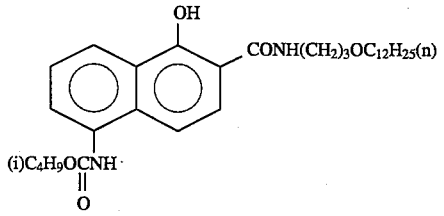

ExC-2

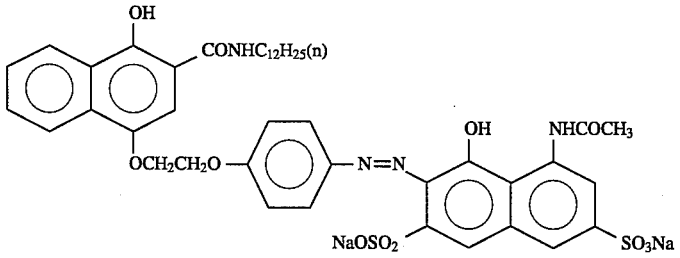

ExC-3

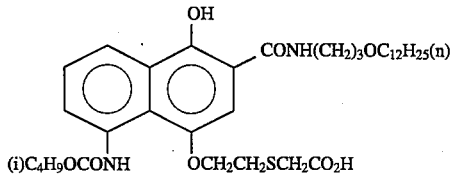

ExC-4

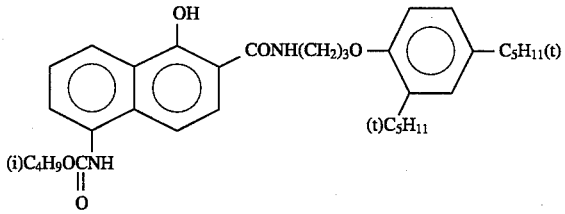

-continued
ExC-5
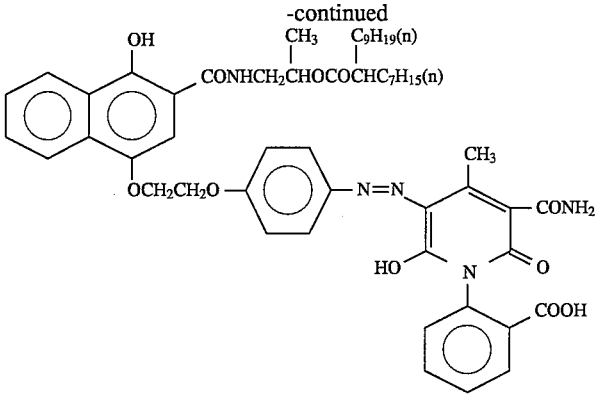
ExC-6
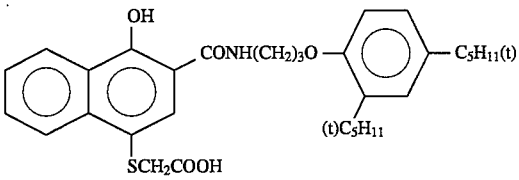
ExC-7
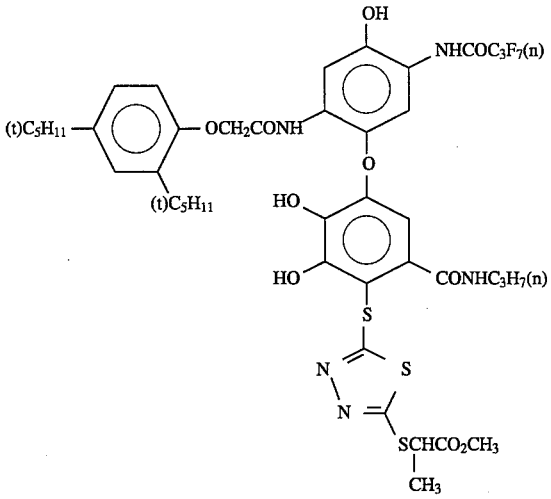
ExC-8
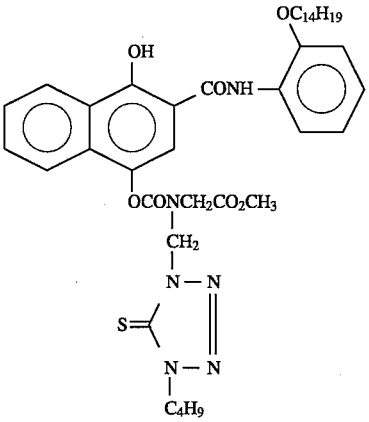

-continued
ExM-1
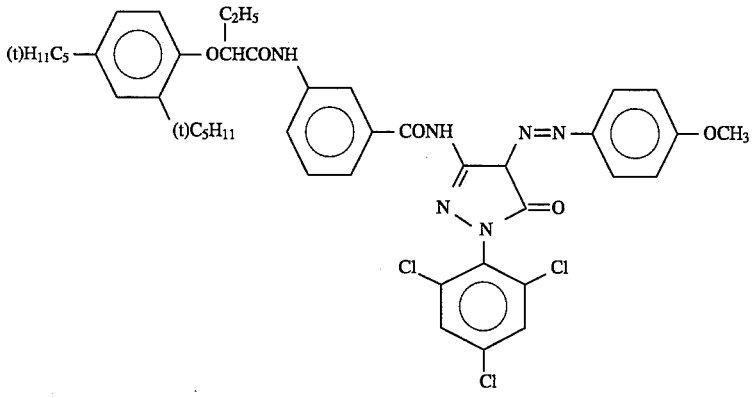
ExM-2
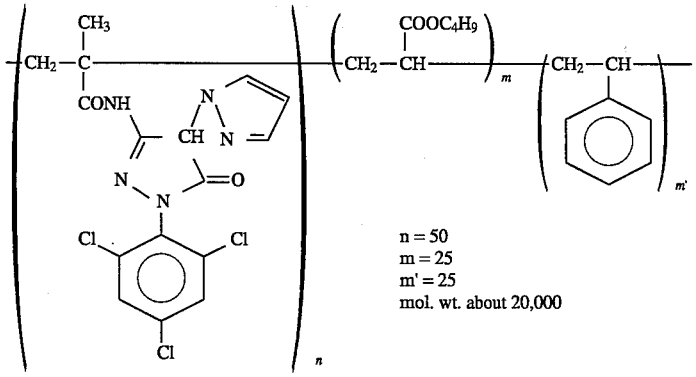
n = 50
m = 25
m' = 25
mol. wt. about 20,000
ExM-3
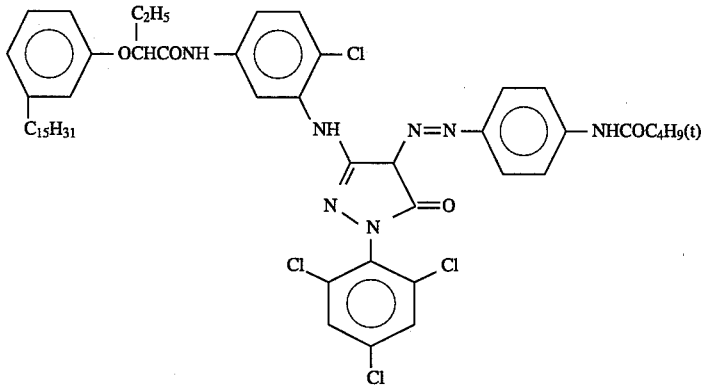
ExM-4
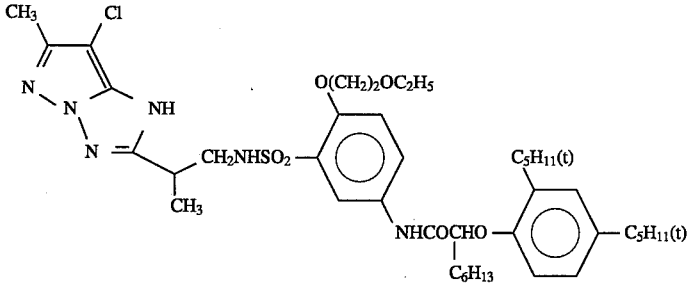

-continued
ExM-5
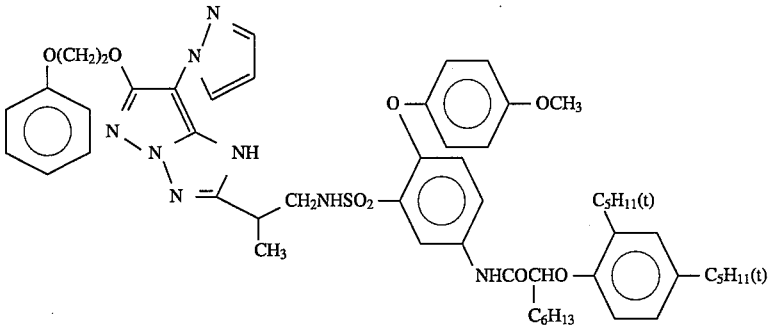
ExY-1
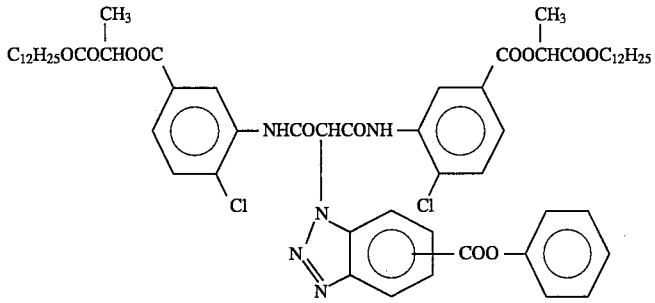
ExY-2
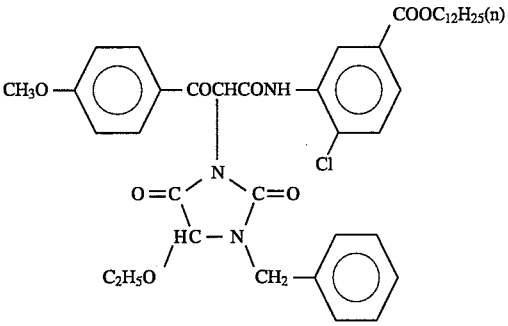
ExY-3
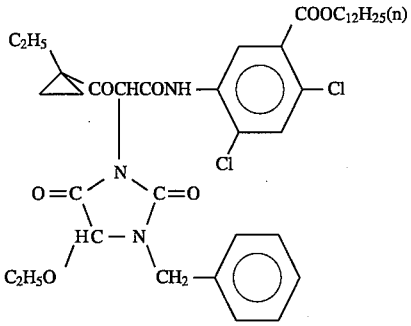
ExY-4
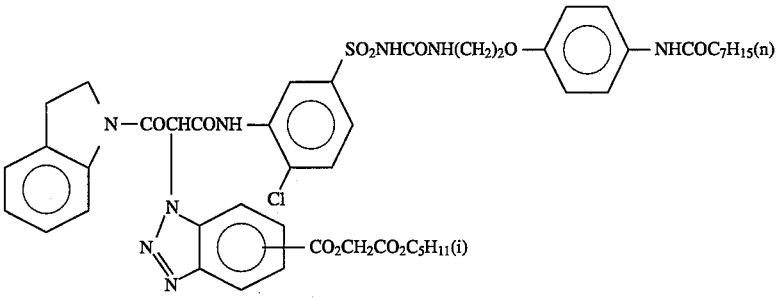
ExY-5
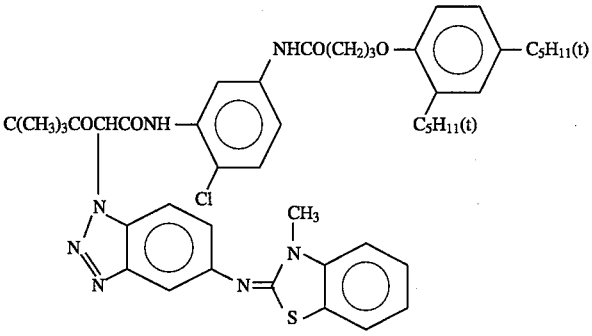

-continued
ExF-1
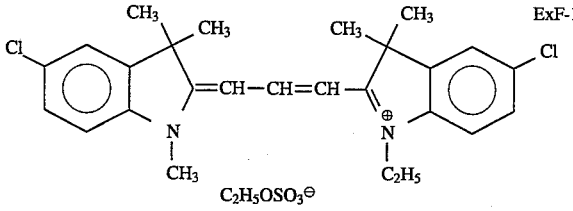
Cpd-1
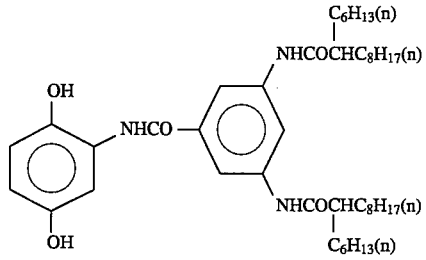
Cpd-2
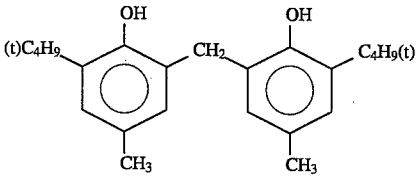
Cpd-3
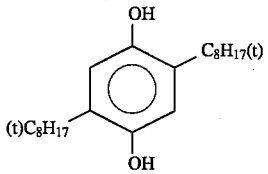
UV-1
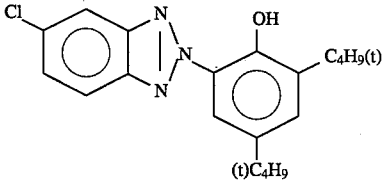
UV-2
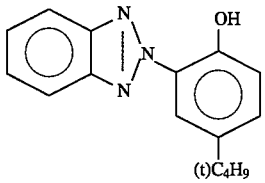
UV-3
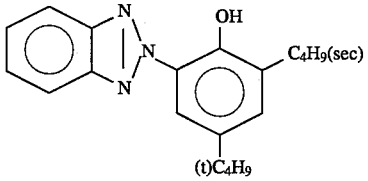
UV-4
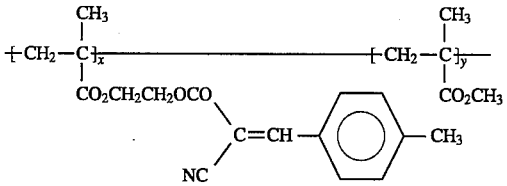
x:y = 70:30 (wt %)
UV-5
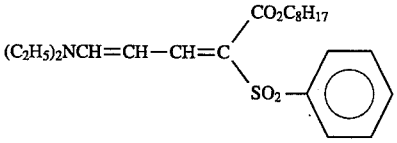
Tricresylphosphate
HBS-1
Di-n-butylphthalate
HBS-2
HBS-3
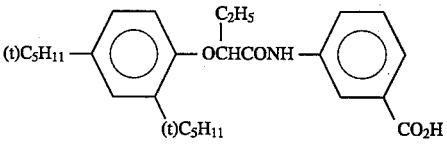
ExS-1
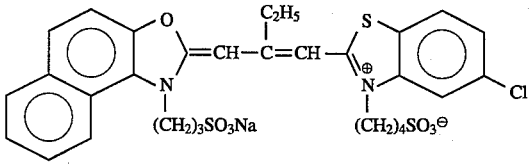
ExS-2
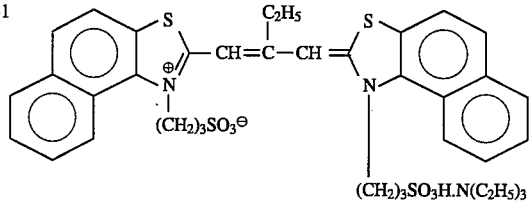
ExS-3
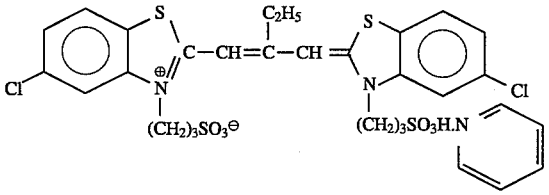

-continued
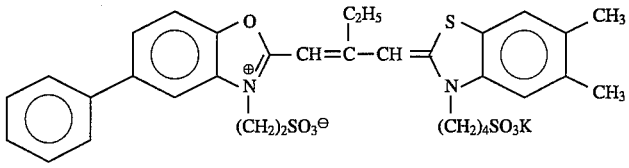
ExS-4
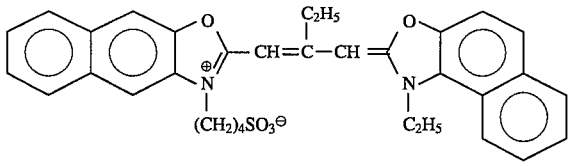
ExS-5
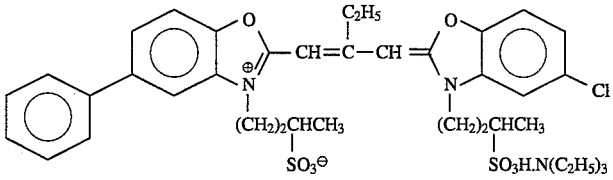
ExS-6
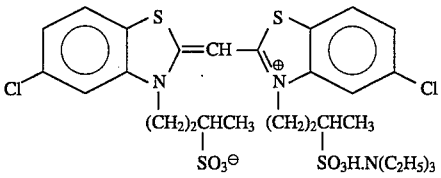
ExS-7
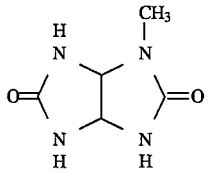
S-1
$CH_2{=}CH{-}SO_2{-}CH_2{-}CONH{-}CH_2$
$CH_2{=}CH{-}SO_2{-}CH_2{-}CONH{-}CH_2$
H-1
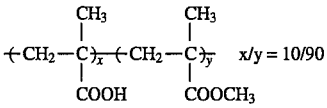
x/y = 10/90
B-1
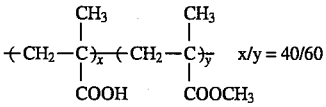
x/y = 40/60
B-2
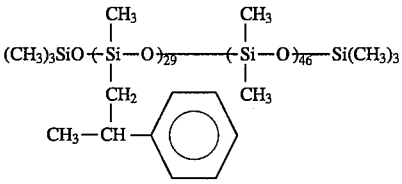
B-3
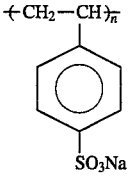
B-4
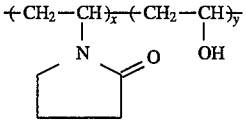
x/y = 70/30
B-5
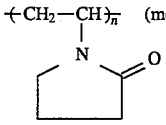
(mol. wt. about 10,000)
B-6
$C_8F_{17}SO_2NHCH_2CH_2CH_2OCH_2CH_2\overset{\oplus}{N}(CH_3)_3$
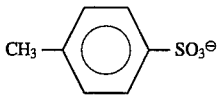
W-1
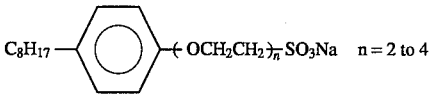
$n = 2$ to 4
W-2
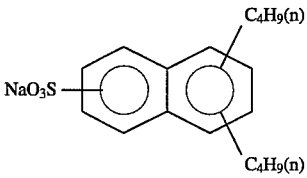
W-3

-continued

F-1

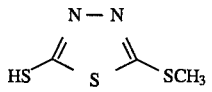

F-2

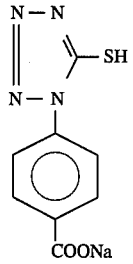

F-3

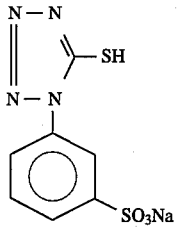

F-4

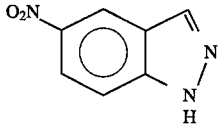

F-5

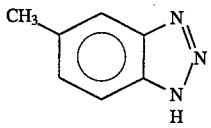

F-6

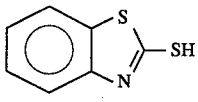

F-7

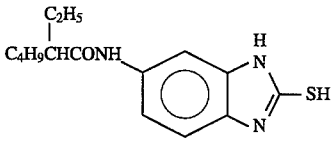

F-8

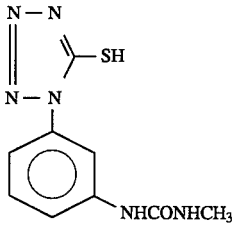

F-9

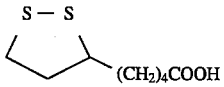

F-10

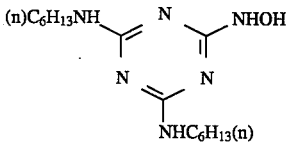

F-11

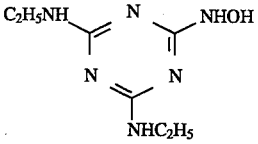

F-12

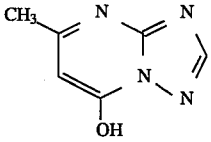

F-13

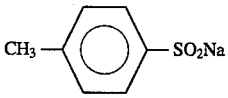

F-14

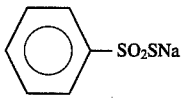

F-15

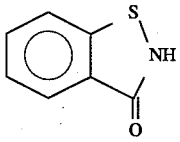

F-16

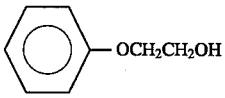

F-17

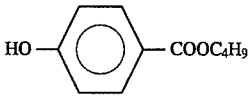

Samples 102 to 111 were formed following the same procedures as for the sample 101 formed as described above except the emulsions in the 5th, 9th, and 12th layers, as high-speed layers, were changed as shown in Table 2 and the emulsions in the 3rd, 7th, and 11th layers, as low-speed layers, were changed as shown in Table 3. The tabular emulsions were prepared in accordance with the method described in JP-A-3-237450. The regular crystal emulsions were prepared in accordance with the methods described in JP-A-54-48521 and JP-A-58-49938.

TABLE 2

| Silver halide emulsions in 5th, 9th, and 12th layers | | | | | | | | |
|---|---|---|---|---|---|---|---|---|
| Sample No. | Average grain size | Variation coefficient | AR | Grain structure silver amount ratio | AgI content (mol %) | Average AgI content (mol %) | Shape | Chemical sensiti-zation |
| 101 | 1.1 | 16 | 6 | 6/64/30 | 0.2/1/5.5 | 2.3 | Tabular | Selenium |
| 102 | 1.1 | 16 | 6 | 6/64/30 | 0.2/1/5.5 | 2.3 | Tabular | Selenium |
| 103 | 1.1 | 16 | 6 | 6/64/30 | 0.2/5/5.5 | 4.4 | Tabular | Selenium |
| 104 | 1.1 | 16 | 6 | 6/64/30 | 0.2/5/5.5 | 4.4 | Tabular | Selenium |
| 105 | 1.1 | 25 | 6 | 6/64/30 | 0.2/5/5.5 | 4.4 | Tabular | Selenium |
| 106 | 1.1 | 25 | 6 | 6/64/30 | 0.2/5/5.5 | 4.4 | Tabular | Selenium |
| 107 | 1.1 | 25 | 6 | 6/64/30 | 0.2/5/5.5 | 4.4 | Tabular | Selenium |
| 108 | 1.1 | 25 | 6 | 6/64/30 | 0.2/5/5.5 | 4.4 | Tabular | |
| 109 | 1.1 | 25 | 6 | 6/64/30 | 0.2/5/5.5 | 4.4 | Tabular | |
| 110 | 1.1 | 25 | 1 | 6/64/30 | 0.2/5/5.5 | 4.4 | Cubic | Selenium |
| 111 | 1.1 | 25 | 1 | 6/64/30 | 0.2/5/5.5 | 4.4 | Octahedral | Selenium |

AR means an aspect ratio, and AR = 6 means that silver halide grains with an aspect ratio of 6 or more occupy 50% or more of a projected area.
The emulsions shown in Table 2 were subjected to reduction sensitization and gold and sulfur sensitizations in accordance with JP-A-2-191938.

TABLE 3

| Silver halide emulsions in 3rd, 7th, and 11th layers | | | | | | | | |
|---|---|---|---|---|---|---|---|---|
| Sample No. | Average grain size | Variation coefficient | AR | Grain structure silver amount ratio | AgI content (mol %) | Average AgI content (mol %) | Shape | Chemical sensiti-zation |
| 101 | 0.5 | 8 | 1 | 1/0/1 | 1/0/2 | 1.5 | Cubic | Selenium |
| | 0.3 | 10 | 1 | 1/0/1 | 1/0/2 | 1.5 | Cubic | Selenium |
| 102 | 0.5 | 8 | 1 | 1/0/1 | 1/0/2 | 1.5 | Octahedral | Selenium |
| | 0.3 | 10 | 1 | 1/0/1 | 1/0/2 | 1.5 | Octahedral | Selenium |
| 103 | 0.5 | 8 | 1 | 1/0/1 | 3/0/6 | 4.5 | Cubic | Selenium |
| | 0.3 | 10 | 1 | 1/0/1 | 3/0/6 | 4.5 | Cubic | Selenium |
| 104 | 0.5 | 8 | 1 | 1/0/1 | 3/0/6 | 4.5 | Octahedral | Selenium |
| | 0.3 | 10 | 1 | 1/0/1 | 3/0/6 | 4.5 | Octahedral | Selenium |
| 105 | 0.5 | 8 | 1 | 1/0/1 | 3/0/6 | 4.5 | Cubic | Selenium |
| | 0.3 | 10 | 1 | 1/0/1 | 3/0/6 | 4.5 | Cubic | Selenium |
| 106 | 0.5 | 8 | 1 | 1/0/1 | 3/0/6 | 4.5 | Octahedral | Selenium |
| | 0.3 | 10 | 1 | 1/0/1 | 3/0/6 | 4.5 | Octahedral | Selenium |
| 107 | 0.5 | 8 | 1 | 1/0/1 | 3/0/6 | 4.5 | Cubic | |
| | 0.3 | 10 | 1 | 1/0/1 | 3/0/6 | 4.5 | Cubic | |
| 108 | 0.5 | 8 | 3 | 1/0/1 | 3/0/6 | 4.5 | Tabular | |
| | 0.3 | 10 | 3 | 1/0/1 | 3/0/6 | 4.5 | Tabular | |
| 109 | 0.5 | 8 | 1 | 1/0/1 | 3/0/6 | 4.5 | Cubic | Selenium |
| | 0.3 | 10 | 1 | 1/0/1 | 3/0/6 | 4.5 | Cubic | Selenium |
| 110 | 0.5 | 8 | 1 | 1/0/1 | 3/0/6 | 4.5 | Cubic | Selenium |
| | 0.3 | 10 | 1 | 1/0/1 | 3/0/6 | 4.5 | Cubic | Selenium |
| 111 | 0.5 | 8 | 1 | 1/0/1 | 3/0/6 | 4.5 | Cubic | Selenium |
| | 0.3 | 10 | 1 | 1/0/1 | 3/0/6 | 4.5 | Cubic | Selenium |

AR means an aspect ratio, and AR = 6 means that silver halide grains with an aspect ratio of 6 or more occupy 50% or more of a projected area.
The emulsions shown in Table 3 were subjected to reduction sensatization and gold and sulfur sensatizations in accordance with JP-A-2-191938.

All of the light-sensitive materials (samples 101 to 111) specified by the emulsion formulas listed in Tables 2 and 3 had a specific photographic sensitivity of 100 or more.

After being photographed at a standard exposure level, the samples 101 to 111 were separately subjected to continuous processing in accordance with the following processing method. Note that the processing was performed until the accumulated quantity of replenisher of a color developing solution became three times the tank volume.

| Process | (Processing Method) Time | Temperature | Quantity of replenisher* | Tank volume |
|---|---|---|---|---|
| Color development | 3 min. 15 sec. | 38° C. | 16 ml | 10 l |
| Bleaching | 40 sec. | 38° C. | 5 ml | 4 l |
| Fixing (1) | 40 sec. | 38° C. | — | 4 l |
| Fixing (2) | 40 sec. | 38° C. | 30 ml | 4 l |
| Washing (1) | 30 sec. | 38° C. | — | 2 l |
| Washing (2) | 30 sec. | 38° C. | 30 ml | 2 l |
| Stabilization | 30 sec. | 38° C. | 20 ml | 2 l |
| Drying | 1 min. | 55° C. | | |

*The quantity of replenisher is represented by a value per meter of a 35-mm wide sample.

Each of the fixing and washing process was performed by a counter current scheme from (2) to (1), and the overflow solution of the bleaching solution was introduced entirely to the fixing (1).

Note that the amount of the fixing solution carried over to the washing process in the above processing was 2 ml per meter of a 35-mm wide light-sensitive material.

The crossover time of each step was five seconds, and this time was included in the processing time of each previous process.

The compositions of the processing solutions are presented below.

| | Mother solution (g) | Replenisher (g) |
|---|---|---|
| (Color developing solution) | | |
| Diethylenetriamine pentaacetic acid | 1.0 | 1.1 |
| 1-hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Additives | $3.0 \times 10^{-2}$ mol | $4.5 \times 10^{-2}$ mol |
| 4-(N-ethyl-N-β-hdroxyethylamino)-2-methylaniline sulfate | 4.5 | 8.0 |
| Water to make | 1.0 l | 1.0 l |
| pH | 10.05 | 10.20 |
| (Bleaching solution) | | |
| Ferric ammonium 1,3-diaminopropane tetraacetate monohydrate (1,3-DPTA · Fe(III)) | 144.0 | 206.0 |
| 1,3-diaminopropane tetraacetic acid | 2.8 | 4.0 |
| Ammonium bromide | 84.0 | 120.0 |
| Ammonium nitrate | 90.0 | 125.0 |
| Hydroxyacetic acid (7.1%) | 93.6 | 130.0 |
| Water to make | 1.0 l | 1.0 l |
| pH (controlled by ammonia water (27%)) | 4.0 | 3.2 |
| (Fixing solution) | | |
| 1,3-diaminopropane tetraacetic acid | 4.5 | 22.5 |
| Imidazole | 30.0 | 3.30 |
| Ammonium sulfite | 12.0 | 20.0 |
| Aqueous ammonium thiosulfate solution (700 g/l) | 290.0 ml | 320.0 ml |
| Ammonia water (27%) | 6.0 ml | 15.0 ml |
| Water to make | 1.0 l | 1.0 l |

-continued

| | Mother solution (g) | Replenisher (g) |
|---|---|---|
| pH | 6.8 | 8.0 |
| (Washing solution) | common to mother solution and replenisher (g) | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 150 mg/l of sodium sulfate were added. The pH of the solution fell within the range of 6.5 to 7.5.

| (Stabilizing solution) | common to mother solution and replenisher (g) |
|---|---|
| Formalin (37%) | 2.0 ml |
| Polyoxyethylene-p-monononylphenylether (average degree of polymerization 10) | 0.3 |
| Disodium ethylenediamine tetraacetate | 0.05 |
| Water to make | 1.0 l |
| pH | 5.0–8.0 |

Sensitometry exposure, development, and density measurement were performed before and after the continuous processing in accordance with conventional methods, thereby measuring the sensitivities and gradations of red-, green-, and blue-sensitive layers. The results of gradation changes before and after the continuous processing are summarized in Table 4. In Table 4, the gradation is indicated by an average gradation of minimum density+0.2 to 1.5.

TABLE 4

Gradation change before and after continuous processing

| Sample No. | Red-sensitive layer | Green-sensitive layer | Blue-sensitive layer | Remarks |
|---|---|---|---|---|
| 101 | ±0 | ±0 | ±0 | Present invention |
| 102 | −2 | −3 | −4 | Present invention |
| 103 | −1 | −1 | −3 | Present invention |
| 104 | −3 | −4 | −5 | Present invention |
| 105 | −2 | −2 | −2 | Present invention |
| 106 | −4 | −6 | −7 | Present invention |
| 107 | −16 | −17 | −18 | Comparative example |
| 108 | −20 | −22 | −24 | Comparative example |
| 109 | −20 | −21 | −22 | Comparative example |
| 110 | −18 | −19 | −19 | Comparative example |
| 111 | −19 | −20 | −21 | Comparative example |

Table 4 reveals that 1) the gradation change before and after the continuous processing is extremely small by using selenium-sensitized tabular emulsions in high-speed layers and selenium-sensitized regular crystal emulsions in low-speed layers; 2) this effect is further enhanced when the average AgI amount of the tabular emulsion is 4 mol % or less and the average AgI amount of the regular crystal emulsion is 4 mol % or less; and 3) a cubic emulsion in which the ratio of (100) faces is high is significantly excellent among other regular crystal emulsions.

That is, it was confirmed that the gradation change before and after the continuous processing was decreased in each sample of the present invention. In particular, the sample using the cubic emulsions in low-speed layers caused no gradation change and was very stable in photographic property even with a small quantity of replenisher of a developing solution of 16 ml per meter of a 35-mm wide material, i.e., 457 ml/m$^2$.

The similar processing was performed by changing the quantity of color developing replenisher to 18.5 ml per meter of a 35-mm wide material, i.e., 528 ml/m$^2$, checking the gradation change before and after the continuous processing for each of the samples 101 to 111. As a consequence, no large difference in gradation change was found among the light-sensitive materials, and so it was confirmed that the quantity of replenisher had critical points.

EXAMPLE 2

The following processing was performed for the samples 101 to 111 to check the gradation change before and after the continuous processing. The results were similar to those obtained in Example 1.

That is, each color photographic light-sensitive material was exposed and then processed (until the accumulated quantity of replenisher of a developing solution became three times the tank volume) by using an automatic developing machine in accordance with the following method.

(Processing Method)

| Process | Time | Temperature | Quantity of replenisher* | Tank volume |
|---|---|---|---|---|
| Color development | 3 min. 15 sec. | 38° C. | 16 ml | 20 l |
| Bleaching | 3 min. 00 sec. | 38° C. | 25 ml | 40 l |
| Washing | 30 sec. | 24° C. | 1,200 ml | 20 l |
| Fixing | 3 min. 00 sec. | 38° C. | 25 ml | 30 l |
| Washing (1) | 30 sec. | 24° C. | counter current piping from (2) to (1) | 10 l |
| Washing (2) | 30 sec. | 24° C. | 1,200 ml | 10 l |
| Stabilization | 30 sec. | 38° C. | 25 ml | 10 l |
| Drying | 4 min. 20 sec. | 55° C. | | |

*The quantity of replenisher is represented by a value per meter of a 35-mm wide sample.

The compositions of the processing solutions are presented below.

| | Tank solution (g) | Replenisher (g) |
|---|---|---|
| (Color developing solution) | | |
| Diethylenetriamine pentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.3 |
| Potassium iodide | 1.5 mg | — |
| Hydroxylaminesulfate | 2.4 | 2.8 |
| 4-[N-ethyl-N-β-hydroxyethylamino]-2-methylaniline sulfate | 4.5 | 6.2 |
| Water to make | 1.0 l | 1.0 l |
| pH | 10.05 | 10.05 |
| (Bleaching solution) | | |
| Ferric sodium ethylenediamine tetraacetate trihydrate | 100.0 | 120.0 |
| Disodium ethylenediamine tetraacetate | 10.0 | 11.0 |
| 3-mercapto-1,2,4-triazole | 0.08 | 0.09 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| (Fixing solution) | | |
| Disodium ethylenediamine tetraacetate | 0.5 | 0.7 |
| Ammonium sulfite | 20.0 | 22.0 |
| Aqueous ammonium thiosulfate solution (700 g/l) | 290.0ml | 320.0ml |
| Water to make | 1.0 l | 1.0 l |
| pH | 6.7 | 7.0 |

| (Stabilizing solution) | common to tank solution and replenisher (g) |
|---|---|
| Sodium p-toluenesulfinate | 0.03 |
| Polyoxyethylene-p-monononyl-phenylether (average degree of polymerization 10) | 0.2 |
| Disodium ethylenediamine tetraacatate | 0.05 |
| 1,2,4-triazole | 1.3 |
| 1,4-bis(1,2,4-triazol-1-yl-methyl)piperazine | 0.75 |
| Water to make | 1.0 l |
| pH | 8.5 |

EXAMPLE 3

The following processing was performed for the samples 101 to 111, thereby checking the gradation change before and after the continuous processing. The results were similar to those obtained in Example 1.

(Processing Method)

| Process | Time | Temperature | Quantity of replenisher* |
|---|---|---|---|
| Color development | 1 min. 40 sec. | 40° C. | 16 ml |
| Bleaching | 40 sec. | 38° C. | 5 ml |
| Fixing | 1 min. 20 sec. | 38° C. | 30 ml |
| Stabilization (1) | 20 sec. | 38° C. | — |
| Stabilization (2) | 20 sec. | 38° C. | — |
| Stabilization (3) | 20 sec. | 38° C. | 40 ml |
| Drying | 1 min. 15 sec. | 55° C. | |

*The quantity of replenisher is represented by a value per meter of a 35-mm wide sample.
*Stabilization was performed by a counter current scheme from (3) to (1).

The compositions of the processing solutions are presented below.

| | Tank solution (g/l) | Replenisher (g/l) |
|---|---|---|
| (Color developing solution) | | |
| Hydroxyethylimino diacetic acid | 3.0 | 3.1 |
| Sodium 1,2-dihydroxybenezene-3,5-disulfonate | 1.0 | 1.0 |
| Sodium sulfite | 3.0 | 4.0 |
| Potassium carbonate | 30.0 | 35.0 |
| Potassium bromide | 1.0 | 0.4 |
| Hydroxylaminesulfate | 2.5 | 3.5 |
| 4-[N-ethyl-N-β-hydroxyethyl-amino]-2-methylaniline sulfate | 6.5 | 7.5 |
| 1-phenyl-4-methyl-4-hydroxy-methyl-3-pyrazolidone | 0.02 | 0.03 |
| 5-nitroindazole | 0.02 | 0.03 |
| pH (controlled by using potassium hydroxide and water) | 10.50 | 10.70 |
| (Bleaching solution) | | |
| Ferric ammonium 1,3-diaminopro- | 60.0 | 75.0 |

-continued

| | Tank solution (g/l) | Replenisher (g/l) |
|---|---|---|
| pane tetraacetate dihydrate | | |
| Ferric ammonium ethylenediamine tetraacetate dihydrate | 120.0 | 140.0 |
| Ammonium bromide | 160.0 | 190.0 |
| Ammonium nitrate | 30.0 | 35.0 |
| pH (controlled by using ammonia acetate water) | 5.0 | 4.5 |
| (Fixing solution) | | |
| Aqueous ammonium thiosulfate solution (700 g/l) | 400.0 ml | 420.0 ml |
| Sodium sulfite | 12.0 | 15.0 |
| Disodium ethylenediamine tetraacetate | 1.0 | 1.0 |
| pH (controlled by using ammonia acetate water) | 7.1 | 7.5 |
| (Stabilizing solution) | | |
| 5-chloro-2-methyl-4-isothiazolin-3-one | 0.006 | 0.006 |
| 2-methyl-4-isothiazolin-3-one | 0.003 | 0.003 |
| Formalin (37%) | 1.0 ml | 1.0 ml |
| Polyoxyethylene-p-monononylphenylether (average degree of polymerization 10) | 0.05 | 0.05 |
| pH | 4.0–8.0 | 4.0–8.0 |

As has been described above in detail, according to the present invention, there are provided a silver halide color photographic light-sensitive material having a high sensitivity, a good graininess, and a high stability in low-replenishment processing, and a method of processing the same.

What is claimed is:

1. A silver halide color photographic light-sensitive material comprising at least two silver halide emulsion layer groups having different color sensitivities on a support, wherein each of said at least two silver halide emulsion layer groups contains at least two silver halide emulsion layers sensitive to essentially the same spectral range and having different sensitivities, a highest-speed layer of said at least two silver halide emulsion layers in each of said silver halide emulsion layer groups contains a silver halide emulsion in which selenium, sulfur and gold-sensitized tabular silver halide grains with an aspect ratio of 3 or more occupy 50% or more of a total projected area, and a lowest-speed layer of said at least two silver halide emulsion layers in each of said silver halide emulsion layer groups contains a silver halide emulsion containing selenium, sulfur and gold-sensitized regular crystal cubic grains, and said cubic grains have a silver iodide content of 3 mol % or less.

2. The silver halide color photographic light-sensitive material according to claim 1, wherein said material has a specific photographic sensitivity of 100 or more, at least one of said silver halide emulsion layer groups comprises three silver halide emulsion layers with different sensitivities, and a medium-speed layer of said three silver halide emulsion layers contains a silver halide emulsion in which silver halide grains with an aspect ratio of 3 or more occupy 50% or more of a total projected area.

3. The silver halide color photographic light-sensitive material according to claim 1, wherein the color sensitivity of each silver halide emulsion layer group is selected from blue sensitivity, green sensitivity, and red sensitivity.

4. The silver halide color photographic light-sensitive material according to claim 1, wherein the silver halide emulsion of said highest-speed layer has an aspect ratio of 3 to 10.

5. The silver halide color photographic light-sensitive material according to claim 1, wherein said material has a specific photographic sensitivity of 320 or more.

6. The silver halide color photographic light-sensitive material according to claim 1, wherein the silver halide emulsion of said highest-speed layer has a silver iodide content of 10 mol % or less.

7. The silver halide color photographic light-sensitive material according to claim 1, wherein the silver halide emulsion of said highest-speed layer has a silver iodide content of 5 mol % or less.

8. The silver halide color photographic light-sensitive material according to claim 1, wherein said silver halide grains in said highest speed layer occupy 85% or more of all silver halide grains contained in the emulsion.

9. The silver halide color photographic light-sensitive material according to claim 1, wherein said silver halide grains in said highest-speed layer are tabular grains having a diameter of 0.15 to 5.0 μm.

10. The silver halide color photographic light-sensitive material according to claim 1, wherein said selenium, sulfur and gold-sensitized silver halide grains are sensitized with $1\times10^{-8}$ mol or more of selenium sensitizer per mol of silver halide.

11. The silver halide color photographic light-sensitive material according to claim 1, wherein said selenium, sulfur and gold-sensitized silver halide grains are sensitized with $1\times10^{-7}$ to $5\times10^{-4}$ mol of sulfur sensitizer per mol of silver halide.

12. The silver halide color photographic light-sensitive material according to claim 1, wherein said selenium, sulfur and gold-sensitized silver halide grains are sensitized with $1\times10^{-7}$ to $5\times10^{-4}$ mol of gold sensitizer per mol of silver halide.

13. The silver halide color photographic light-sensitive material according to claim 1, wherein said material comprises three of said silver halide emulsion layer groups; each of said silver halide emulsion layer groups being sensitive to a different spectral region; said spectral region being selected from the group consisting of blue light, green light, and red light.

14. The silver halide color photographic light-sensitive material according to claim 13, wherein said tabular grains have a core-shell structure.

15. The silver halide color photographic light-sensitive material according to claim 14, wherein said red light-sensitive silver halide emulsion layer group and said green light-sensitive silver halide emulsion layer group each comprise three silver halide emulsion layers with different sensitivities, wherein a medium-speed layer of said three silver halide emulsion layers contains a silver halide emulsion in which tabular silver halide grains having an aspect ratio of 3 or more occupy 50% or more of a total projected area.

16. The silver halide color photographic light-sensitive material according to claim 15, wherein said tabular grains in each of said highest-speed layers have a higher silver iodide content in said shell than in said core.

* * * * *